US009159333B2

(12) United States Patent
Son et al.

(10) Patent No.: US 9,159,333 B2
(45) **Date of Patent: *Oct. 13, 2015**

(54) METHOD AND APPARATUS FOR ADAPTIVELY ENCODING AND DECODING HIGH FREQUENCY BAND

(71) Applicant: Samsung Electronics Co., Ltd., Suwon-si,Gyeonggi do (KR)

(72) Inventors: Chang-yong Son, Gunpo-si (KR); Eun-mi Oh, Seongnam-si (KR); Ki-hyun Choo, Seoul (KR); Jung-hoe Kim, Seoul (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 151 days.

This patent is subject to a terminal disclaimer.

(21) Appl. No.: 13/686,015

(22) Filed: Nov. 27, 2012

(65) Prior Publication Data

US 2014/0149125 A1 May 29, 2014
US 2014/0257822 A9 Sep. 11, 2014

Related U.S. Application Data

(63) Continuation of application No. 13/220,193, filed on Aug. 29, 2011, now Pat. No. 8,340,962, which is a continuation of application No. 11/766,331, filed on Jun. 21, 2007, now Pat. No. 8,010,352.

(30) Foreign Application Priority Data

Jun. 21, 2006 (KR) ..... 10-2006-0056070
Jun. 20, 2007 (KR) ..... 10-2007-0060688

(51) Int. Cl.
*G10L 19/02* (2013.01)
*G10L 21/00* (2013.01)
*G10L 19/08* (2013.01)

(52) U.S. Cl.
CPC ..... *G10L 21/00* (2013.01); *G10L 19/0204* (2013.01); *G10L 19/08* (2013.01)

(58) Field of Classification Search
USPC ..... 704/219–230, 500–504
See application file for complete search history.

(56) References Cited

U.S. PATENT DOCUMENTS 843,019 A * 2/1907 Vainio et al. ..... 137/184
5,455,888 A 10/1995 Iyengar et al.

(Continued)

FOREIGN PATENT DOCUMENTS

EP 1285436 9/2003
EP 1342230 4/2004

(Continued)

OTHER PUBLICATIONS

Japanese Office Action dated May 27, 2014 issued in JP Application No. 2012-143873.

(Continued)

*Primary Examiner* — Abul Azad
(74) *Attorney, Agent, or Firm* — Staas & Halsey LLP

(57) ABSTRACT

Provided are a method and apparatus for encoding and decoding an audio signal. According to the present application, a signal of a high frequency band above a preset frequency band is adaptively encoded or decoded in the time domain or in the frequency domain by using a signal of a low frequency band below the preset frequency band. As such, the sound quality of a high frequency signal is not deteriorate even when an audio signal is encoded or decoded by using a small number of bits and thus coding efficiency may be maximized.

3 Claims, 24 Drawing Sheets

(56) References Cited

U.S. PATENT DOCUMENTS

| | | | | |
|---|---|---|---|---|
| 5,710,863 | A | 1/1998 | Chen | |
| 5,790,759 | A | 8/1998 | Chen | |
| 6,014,621 | A | 1/2000 | Chen | |
| 6,134,518 | A * | 10/2000 | Cohen et al. | 704/201 |
| 6,427,135 | B1 | 7/2002 | Miseki et al. | |
| 6,708,145 | B1 | 3/2004 | Liljeryd et al. | |
| 6,988,066 | B2 | 1/2006 | Malah | |
| 7,318,035 | B2 | 1/2008 | Andersen et al. | |
| 7,739,120 | B2 * | 6/2010 | Makinen | 704/501 |
| 7,844,451 | B2 | 11/2010 | Oshikiri | |
| 8,010,352 | B2 * | 8/2011 | Son et al. | 704/223 |
| 8,069,034 | B2 * | 11/2011 | Makinen et al. | 704/201 |
| 8,116,460 | B2 | 2/2012 | Henn et al. | |
| 8,239,208 | B2 | 8/2012 | Philippe et al. | |
| 8,243,936 | B2 | 8/2012 | Henn et al. | |
| 8,340,962 | B2 * | 12/2012 | Son et al. | 704/223 |
| 2003/0093271 | A1 | 5/2003 | Tsushima et al. | |
| 2003/0195742 | A1 | 10/2003 | Tsushima et al. | |
| 2004/0019492 | A1 | 1/2004 | Tucker et al. | |
| 2004/0125878 | A1 | 7/2004 | Liljeryd et al. | |
| 2004/0153313 | A1 | 8/2004 | Aubauer et al. | |
| 2005/0187759 | A1 | 8/2005 | Malah et al. | |
| 2006/0036432 | A1 | 2/2006 | Kjorling et al. | |
| 2007/0071116 | A1 | 3/2007 | Oshikiri | |
| 2007/0299669 | A1 | 12/2007 | Ehara | |
| 2009/0037180 | A1 * | 2/2009 | Kim et al. | 704/500 |

FOREIGN PATENT DOCUMENTS

| | | |
|---|---|---|
| EP | 1216474 | 7/2004 |
| EP | 1275109 | 9/2004 |
| JP | 09-046233 | 2/1997 |
| JP | 2002-032100 | 1/2001 |
| JP | 2001521648 | 11/2001 |
| JP | 2001525079 | 12/2001 |
| JP | 2003216190 | 7/2003 |
| JP | 2003525473 | 8/2003 |
| JP | 2004004710 | 1/2004 |
| JP | 2004501387 | 1/2004 |
| JP | 2004514179 | 5/2004 |
| JP | 2004535145 | 11/2004 |
| JP | 2005173607 | 6/2005 |
| JP | 2006085183 | 3/2006 |
| JP | 2007501441 | 1/2007 |
| JP | 5031829 | 9/2012 |
| WO | 98/57436 | 12/1998 |
| WO | 0165544 A1 | 9/2001 |
| WO | 2005/027095 | 3/2005 |
| WO | 2005040749 A1 | 5/2005 |
| WO | 2006025313 A1 | 3/2006 |

OTHER PUBLICATIONS

A 7/10/15 kHz Bandwidth Scalable Speech Coder Using Pitch Filtering Based Spectrum Coding, vol. J89D, No. 2, pp. 281-291.

JP Office Action issued Sep. 6, 2011 in JP Patent Application No. 2009-516401.

Japanese Office Action dated Jun. 25, 2013 issued in JP Application 2012-143873.

International Search Report dated Sep. 14, 2007 issued in International Application No. PCT/KR2007/003007.

Substitute Notice of Allowability Office Action issued Nov. 27, 2012 in U.S. Appl. No. 13/220,193 now U.S. Pat. No. 8,340,962, 3 pages.

Notice of Allowance issued Aug. 3, 2012 in U.S. Appl. No. 13/220,193 now U.S. Pat. No. 8,340,962, 5 pages.

Final Office Action issued Apr. 27, 2012 in U.S. Appl. No. 13/220,193 now U.S. Pat. No. 8,340,962, 17 pages.

Non-Final Office Action issued Oct. 24, 2011 in U.S. Appl. No. 13/220,193 now U.S. Pat. No. 8,340,962, 13 pages.

Notice of Allowance issued Apr. 8, 2011 in U.S. Appl. No. 11/766,331 now U.S. Pat. No. 8,010,352, 6 pages.

Non-final Office Action issued Dec. 8, 2010 in U.S. Appl. No. 11/766,331 now U.S. Pat. No. 8,010,352, 14 pages.

Non-final Office Action issued Jul. 15, 2010 in U.S. Appl. No. 11/766,331 now U.S. Pat. No. 8,010,352, 10 pages.

* cited by examiner

METHOD AND APPARATUS FOR ADAPTIVELY ENCODING AND DECODING HIGH FREQUENCY BAND

CROSS-REFERENCE TO RELATED APPLICATIONS

This application is a continuation application of prior application Ser. No. 13/220,193, filed on Aug. 29, 2011 which is a continuation application of Ser. No. 11/766,331 filed Jun. 21, 2007, now U.S. Pat. No. 8,010,352 in the U.S. Patent and Trademark Office, which claims the benefit of Korean Patent Application No. 10-2006-0056070, filed on Jun. 21, 2006 and Korean Patent Application No 10-2007-0060688, filed on Jun. 20, 2007, in the Korean Intellectual Property Office, the disclosure of which is incorporated herein in its entirety by reference.

BACKGROUND OF THE INVENTION

1. Field of the Invention

The present invention relates to a method and apparatus for encoding and decoding an audio signal such as a speech signal or a music signal, and more particularly, to a method and apparatus for encoding and decoding a high frequency signal by using a signal or a spectrum of a low frequency band.

2. Description of the Related Art

In general, signals of high frequency bands are regarded as less important sound to be recognized by humans in comparison with low frequency signal. Accordingly, when an audio signal is coded, if coding efficiency has to be improved due to a restriction of available bits, a signal of a low frequency band is coded by allocating a great number of bits, while a high frequency signal is coded by allocating a small number of bits.

Thus, when the high frequency signal is coded, a method and apparatus for maximizing the quality of sound to be recognized by humans by using the small number of bits are demanded.

SUMMARY OF THE INVENTION

The present invention provides a method and apparatus for adaptively encoding or decoding a high frequency signal above a preset frequency band in the time domain or in the temporal domain by using a signal of a low frequency band below the preset frequency band.

According to an aspect of the present invention, there is provided an apparatus for adaptively encoding a high frequency band, the apparatus including a domain conversion unit which converts a high frequency signal of the high frequency band above a preset frequency band to the time domain or to the frequency domain by frequency bands; a time domain encoding unit which encodes a frequency band converted to the time domain by using an excitation signal of a low frequency band below the preset frequency band; and a frequency domain encoding unit which encodes a frequency band converted to the frequency domain by using an excitation spectrum of the low frequency band.

According to another aspect of the present invention, there is provided an apparatus for adaptively encoding a high frequency band, the apparatus including a noise information encoding unit which selects a frequency band to be used to encode a high frequency spectrum of the high frequency band above a preset frequency band from an excitation spectrum of a low frequency band below the preset frequency band, and encodes information on the selected frequency band; and an envelope information encoding unit which extracts an envelope of the high frequency spectrum and encodes the envelope.

According to another aspect of the present invention, there is provided an apparatus for adaptively encoding a high frequency band, the apparatus including a domain selection unit which selects an encoding domain of a high frequency signal of the high frequency band above a preset frequency band from the time domain and the frequency domain; a time domain encoding unit which encodes the high frequency signal by using an excitation signal of a low frequency band below the preset frequency band, if the domain selection unit selects the time domain; and a frequency domain encoding unit which converts the high frequency signal to the frequency domain, generates a high frequency spectrum, and encodes the high frequency spectrum by using the excitation signal of the low frequency band, if the domain selection unit selects the frequency domain.

According to another aspect of the present invention, there is provided an apparatus for adaptively decoding a high frequency band, the apparatus including a domain determination unit which determines an encoding domain of each frequency band of the high frequency band above a preset frequency band; a time domain decoding unit which decodes a frequency band determined as having been encoded in the time domain by using an excitation signal of a low frequency band below the preset frequency band; and a frequency domain decoding unit which decodes a frequency band determined as having been encoded in the frequency domain by using an excitation spectrum of the low frequency band.

According to another aspect of the present invention, there is provided an apparatus for adaptively decoding a high frequency band, the apparatus including a noise generation unit which generates noise of the high frequency band above a preset frequency band by using information on a frequency band to be used to decode the high frequency band from an excitation spectrum of a low frequency band below the preset frequency band; and an envelope control unit which decodes an envelope of a high frequency spectrum of the high frequency band and controls an envelope of the noise.

According to another aspect of the present invention, there is provided an apparatus for adaptively decoding a high frequency band, the apparatus including a domain determination unit which determines an encoding domain of the high frequency band above a preset frequency band; a time domain decoding unit which decodes a high frequency signal of the high frequency band by using an excitation signal of a low frequency band below the preset frequency band, if the domain determination unit determines that the high frequency band has been encoded in the time domain; and a frequency domain decoding unit which decodes a high frequency spectrum of the high frequency band by using an excitation spectrum of the low frequency band, if the domain determination unit determines that the high frequency band has been encoded in the frequency domain.

According to another aspect of the present invention, there is provided a method of adaptively encoding a high frequency band, the method including converting a high frequency signal of the high frequency band above a preset frequency band to the time domain or to the frequency domain by frequency bands; encoding a frequency band converted to the time domain by using an excitation signal of a low frequency band below the preset frequency band; and encoding a frequency band converted to the frequency domain by using an excitation spectrum of the low frequency band.

According to another aspect of the present invention, there is provided a method of adaptively encoding a high frequency band, the method including selecting a frequency band to be used to encode a high frequency spectrum of the high frequency band above a preset frequency band from an excitation spectrum of a low frequency band below the preset frequency band, and encoding information on the selected frequency band; and extracting an envelope of the high frequency spectrum and encoding the envelope.

According to another aspect of the present invention, there is provided a method of adaptively encoding a high frequency band, the method including selecting an encoding domain of a high frequency signal of the high frequency band above a preset frequency band from the time domain and the frequency domain; encoding the high frequency signal by using an excitation signal of a low frequency band below the preset frequency band, if the domain selection unit selects the time domain; and converting the high frequency signal to the frequency domain, generates a high frequency spectrum, and encoding the high frequency spectrum by using the excitation signal of the low frequency band, if the domain selection unit selects the frequency domain.

According to another aspect of the present invention, there is provided a method of adaptively decoding a high frequency band, the method including determining an encoding domain of each frequency band of the high frequency band above a preset frequency band; decoding a frequency band determined as having been encoded in the time domain by using an excitation signal of a low frequency band below the preset frequency band; and decoding a frequency band determined as having been encoded in the frequency domain by using an excitation spectrum of the low frequency band.

According to another aspect of the present invention, there is provided a method of adaptively decoding a high frequency band, the method including generating noise of the high frequency band above a preset frequency band by using information on a frequency band to be used to decode the high frequency band from an excitation spectrum of a low frequency band below the preset frequency band; and decoding an envelope of a high frequency spectrum of the high frequency band and controlling an envelope of the noise.

According to another aspect of the present invention, there is provided a method of adaptively decoding a high frequency band, the method including determining an encoding domain of the high frequency band above a preset frequency band; decoding a high frequency signal of the high frequency band by using an excitation signal of a low frequency band below the preset frequency band, if the domain determination unit determines that the high frequency band has been encoded in the time domain; and decoding a high frequency spectrum of the high frequency band by using an excitation spectrum of the low frequency band, if the domain determination unit determines that the high frequency band has been encoded in the frequency domain.

According to another aspect of the present invention, there is provided a computer readable recording medium having recorded thereon a computer program for executing a method of adaptively encoding a high frequency band, the method including converting a high frequency signal of the high frequency band above a preset frequency band to the time domain or to the frequency domain by frequency bands; encoding a frequency band converted to the time domain by using an excitation signal of a low frequency band below the preset frequency band; and encoding a frequency band converted to the frequency domain by using an excitation spectrum of the low frequency band.

According to another aspect of the present invention, there is provided a computer readable recording medium having recorded thereon a computer program for executing a method of adaptively encoding a high frequency band, the method including selecting a frequency band to be used to encode a high frequency spectrum of the high frequency band above a preset frequency band from an excitation spectrum of a low frequency band below the preset frequency band, and encoding information on the selected frequency band; and extracting an envelope of the high frequency spectrum and encoding the envelope.

According to another aspect of the present invention, there is provided a computer readable recording medium having recorded thereon a computer program for executing a method of adaptively encoding a high frequency band, the method including selecting an encoding domain of a high frequency signal of the high frequency band above a preset frequency band from the time domain and the frequency domain; encoding the high frequency signal by using an excitation signal of a low frequency band below the preset frequency band, if the domain selection unit selects the time domain; and converting the high frequency signal to the frequency domain, generates a high frequency spectrum, and encoding the high frequency spectrum by using the excitation signal of the low frequency band, if the domain selection unit selects the frequency domain.

According to another aspect of the present invention, there is provided a computer readable recording medium having recorded thereon a computer program for executing a method of adaptively decoding a high frequency band, the method including determining an encoding domain of each frequency band of the high frequency band above a preset frequency band, decoding a frequency band determined as having been encoded in the time domain by using an excitation signal of a low frequency band below the preset frequency band, and decoding a frequency band determined as having been encoded in the frequency domain by using an excitation spectrum of the low frequency band.

According to another aspect of the present invention, there is provided a computer readable recording medium having recorded thereon a computer program for executing a method of adaptively decoding a high frequency band, the method including generating noise of the high frequency band above a preset frequency band by using information on a frequency band to be used to decode the high frequency band from an excitation spectrum of a low frequency band below the preset frequency band; and decoding an envelope of a high frequency spectrum of the high frequency band and controlling an envelope of the noise.

According to another aspect of the present invention, there is provided a computer readable recording medium having recorded thereon a computer program for executing a method of adaptively decoding a high frequency band, the method including determining an encoding domain of the high frequency band above a preset frequency band; decoding a high frequency signal of the high frequency band by using an excitation signal of a low frequency band below the preset frequency band, if the domain determination unit determines that the high frequency band has been encoded in the time domain; and decoding a high frequency spectrum of the high frequency band by using an excitation spectrum of the low frequency band, if the domain determination unit determines that the high frequency band has been encoded in the frequency domain.

BRIEF DESCRIPTION OF THE DRAWINGS

The above and other features and advantages of the present invention will become more apparent by describing in detail exemplary embodiments thereof with reference to the attached drawings in which.

DETAILED DESCRIPTION OF THE PREFERRED EMBODIMENTS

Hereinafter, the present invention will be described in detail by explaining embodiments of the invention with reference to the attached drawings.

Figure 1A:
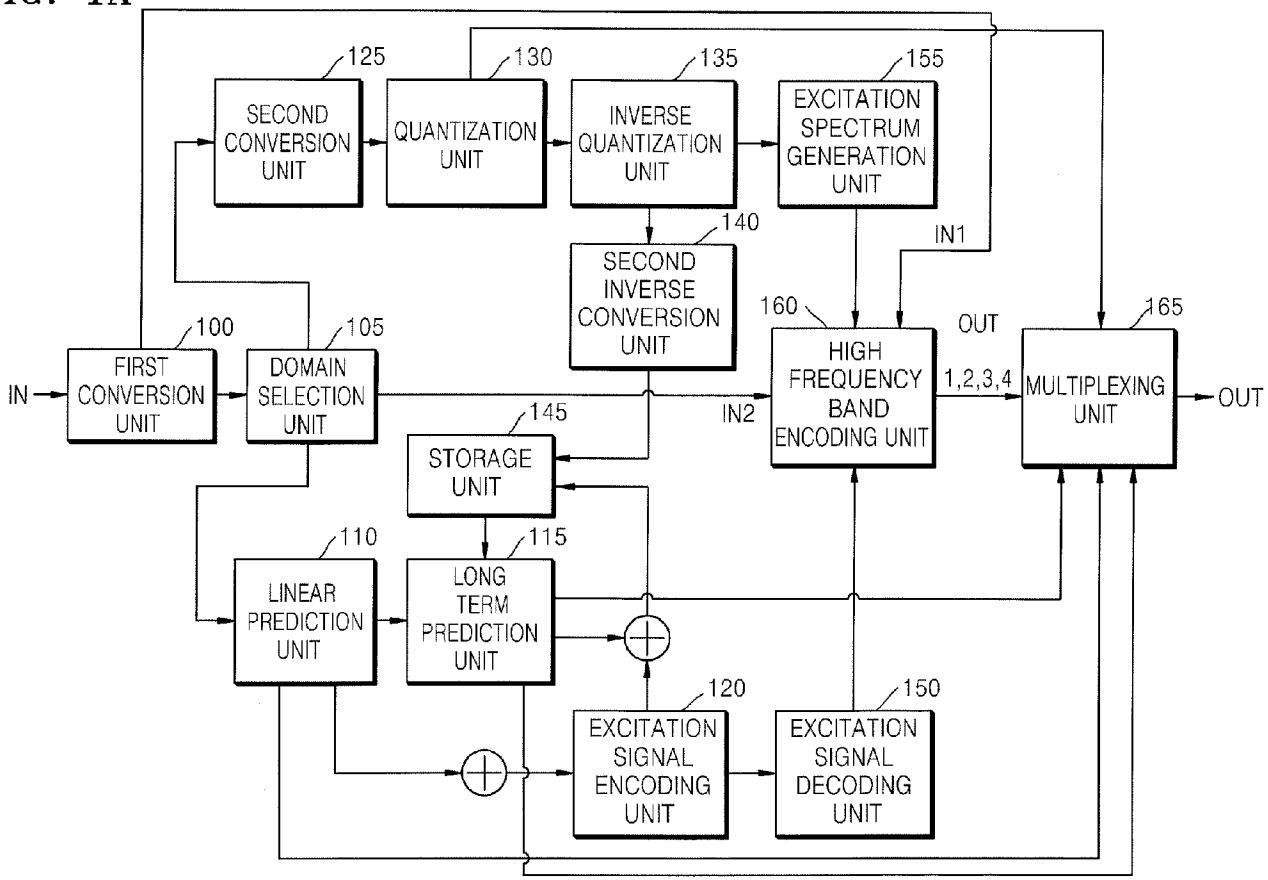
FIG. 1A is a block diagram of an apparatus for adaptively encoding a high frequency band, according to an embodiment of the present invention.

FIG. 1A is a block diagram of an apparatus for adaptively encoding a high frequency band, according to an embodiment of the present invention.

Referring to FIG. 1A, the apparatus includes a first conversion unit 100, a domain selection unit 105, a linear prediction unit 110, a long term prediction unit 115, an excitation signal encoding unit 120, a second conversion unit 125, a quantization unit 130, an inverse quantization unit 135, a second inverse conversion unit 140, a storage unit 145, an excitation signal decoding unit 150, an excitation spectrum generation unit 155, a high frequency band encoding unit 160, and a multiplexing unit 165.

The first conversion unit 100 converts a signal input through an input terminal IN into a signal of the time domain by frequency bands. The first conversion unit 100 may convert the signal by using a quadrature mirror filterbank (QMF) method or a lapped orthogonal transformation (LOT) method.

However, the first conversion unit 100 may convert the signal into a signal of the time domain and a signal of the frequency domain signal by using, for example, a frequency varying-modulated lapped transformation (FV-MLT) method. In this case, the apparatus may not include the second conversion unit 125 so that the first conversion unit 100 may converts the signal into a signal of a domain selected by the domain selection unit 105.

The domain selection unit 105 determines whether to encode each signal of a low frequency band below a preset frequency band from the signal of a frequency band converted by the first conversion unit 100 in the time domain or in the frequency domain in accordance with a preset standard. Also, the domain selection unit 105 encodes information on an encoding domain of each frequency band and outputs the information to the multiplexing unit 165.

Here, the preset standard may be a gain of linear predictive coding (LPC), spectral variations between linear prediction filters of neighboring frames, a pitch delay gain, a long term prediction gain, etc.

The linear prediction unit 110 extracts and encodes LPC coefficients by performing an LPC analysis on a signal of a frequency band determined to be encoded in the time domain by the domain selection unit 105, and extracts a first excitation signal by removing short term correlations from a signal of a frequency band determined to be encoded in the time domain.

The long term prediction unit 115 extracts a second excitation signal by performing long term prediction on the first excitation signal extracted by the linear prediction unit 110. Also, the long term prediction unit 115 encodes the result obtained by performing the long term prediction and output the result to the multiplexing unit 165.

The long term prediction unit 115 may perform the long term prediction, for example, by measuring continuity of periodicity, frequency spectral tilt, or frame energies. Here, the continuity of periodicity may be a degree of continuity of frames which have low variations of pitch lags and high pitch correlations over a certain section. Also, the continuity of periodicity may be a degree of continuity of frames which have very low first formant frequencies and high pitch correlations over a certain section.

The excitation signal encoding unit 120 encodes the second excitation signal extracted by the long term prediction unit 115.

The second conversion unit 125 generates a spectrum by converting a signal of a frequency band determined to be encoded in the frequency domain by the domain selection unit 105 from the time domain to the frequency domain.

The quantization unit 130 quantizes the spectrum generated by the second conversion unit 125. The spectrum quantized by the quantization unit 130 is output to the multiplexing unit 165.

The inverse quantization unit 135 inverse quantizes the spectrum quantized by the quantization unit 130.

The second inverse conversion unit 140 performs inverse operation of the conversion performed by the second conversion unit 125 by inverse converting the spectrum inverse quantized by the inverse quantization unit 135 from the frequency domain to the time domain.

The storage unit 145 stores the signal inverse converted by the second inverse conversion unit 140. The storage unit 145 stores the inverse converted signal in order to use the inverse converted signal when the long term prediction unit 115 performs the long term prediction on a signal of a frequency band to be encoded in the time domain from a next frame.

The excitation signal decoding unit 150 decodes the second excitation signal encoded by the excitation signal encoding unit 120.

The excitation spectrum generation unit 155 generates an excitation spectrum by whitening the spectrum inverse quantized by the inverse quantization unit 135.

The high frequency band encoding unit 160 adaptively encodes a signal of a high frequency band above the preset frequency band in the time domain or in the frequency domain by using a signal of a low frequency band below the preset frequency band. If the high frequency band encoding unit 160 encodes the signal in the time domain, the second excitation signal decoded by the excitation signal decoding unit 150 is used, and if the high frequency band encoding unit 160 encodes the signal in the frequency domain, the excitation spectrum generated by the excitation spectrum generation unit 155 is used.

The multiplexing unit 165 generates a bitstream by multiplexing the information on the encoding domain of each frequency band, the information encoded by the domain selection unit 105, the LPC coefficients encoded by the linear prediction unit 110, the result of the long term prediction performed by the long term prediction unit 115, the second excitation signal encoded by the excitation signal encoding unit 120, the spectrum quantized by the quantization unit 130, the result encoded by the high frequency band encoding unit 160, etc. The bitstream is output through an output terminal OUT.

Figure 1B:
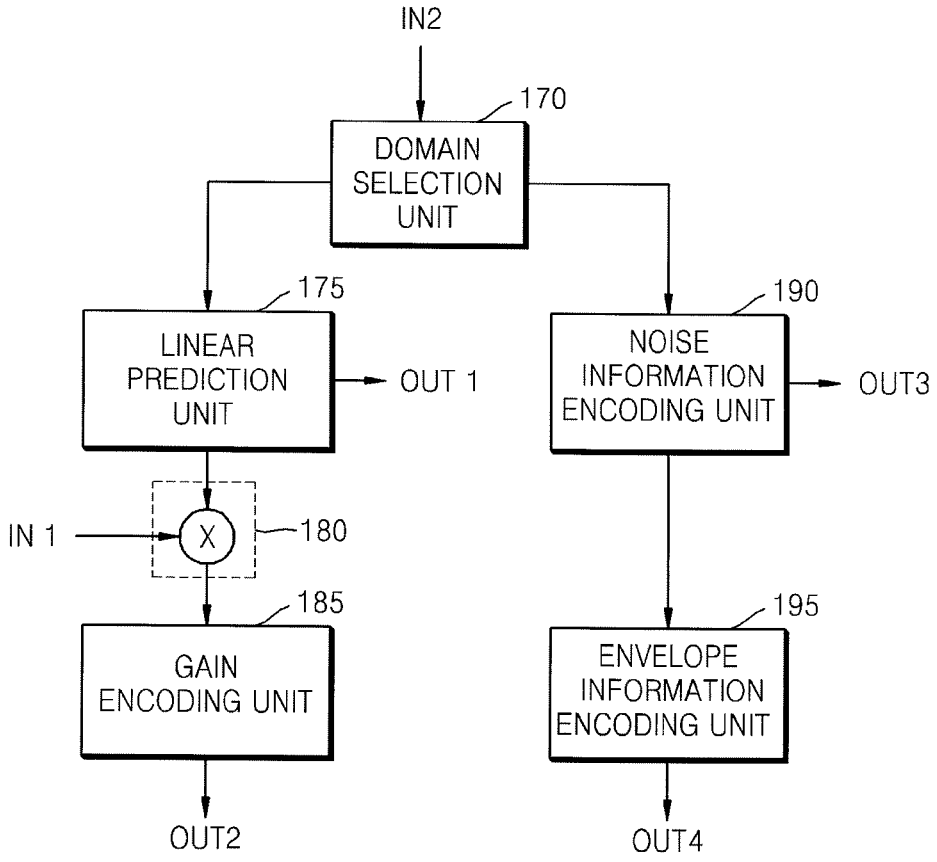
FIG. 1B is a block diagram of a high frequency band encoding unit 160 included in the apparatus illustrated in FIG. 1A, according to an embodiment of the present invention.

FIG. 1B is a block diagram of the high frequency band encoding unit 160 included in the apparatus illustrated in FIG. 1A, according to an embodiment of the present invention.

Figure 7A:
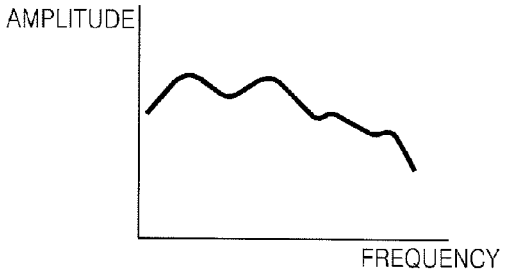
FIG. 7A is a graph of an envelope restored by linear predictive coding (LPC) coefficients, according to an embodiment of the present invention.

FIG. 7A is a graph of an envelope restored by LPC coefficients, according to an embodiment of the present invention.

Figure 7B:
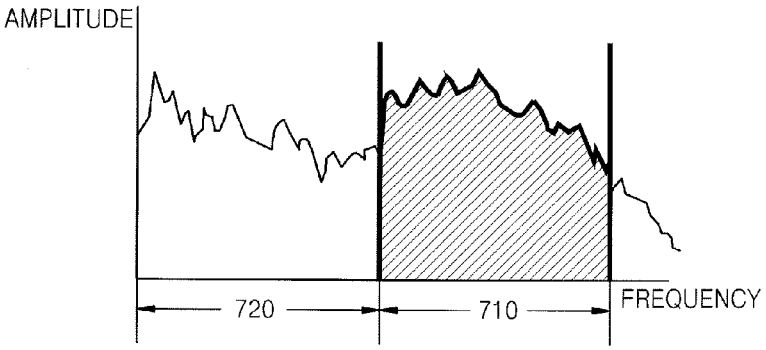
FIG. 7B is a graph of a result obtained by multiplying an excitation signal by an envelope restored by a low frequency signal and LPC coefficients, according to an embodiment of the present invention.

FIG. 7B is a graph of a result obtained by multiplying an excitation signal by an envelope restored by a low frequency signal and LPC coefficients, according to an embodiment of the present invention.

Figure 7C:
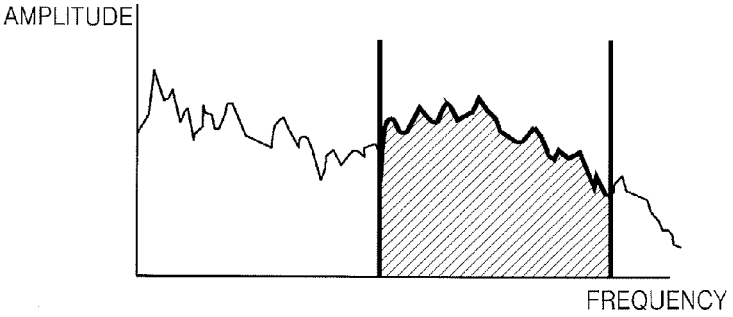
FIG. 7C is a graph of a result obtained by compensating for a mismatch between a low frequency signal and a high frequency signal, according to an embodiment of the present invention.

FIG. 7C is a graph of a result obtained by compensating for a mismatch between a low frequency signal and a high frequency signal, according to an embodiment of the present invention.

Referring to FIG. 1B, the high frequency band encoding unit 160 includes a domain selection unit 170, a linear prediction unit 175, a multiplier 180, a gain encoding unit 185, a noise information encoding unit 190, and an envelope information encoding unit 195.

The domain selection unit 170 determines whether to encode a signal of a high frequency band above a preset frequency band in the time domain or in the frequency domain.

The domain selection unit 170 may determine whether to encode the high frequency band in the time domain or in the frequency domain in accordance with whether a low frequency band below the preset frequency band, which is used when the high frequency band is encoded, is encoded in the time domain or in the frequency domain. If a low frequency band, which is used when the high frequency band is encoded, is encoded in the time domain, the high frequency band is determined to be encoded in the time domain, and if the low frequency band, which is used when the high frequency band is encoded, is encoded in the frequency domain, the high frequency band is determined to be encoded in the frequency domain.

The linear prediction unit 175 extracts LPC coefficients by performing an LPC analysis on the frequency band determined to be encoded in the time domain by the domain selection unit 170. The LPC coefficients extracted by the linear prediction unit 175 are encoded and output to the multiplexing unit 165 illustrated in FIG. 1A through a first output terminal OUT 1, and are used to restore an envelope as illustrated in FIG. 7A by a decoder.

The multiplier 180 multiplies the second excitation signal which is decoded by the excitation signal decoding unit 150 illustrated in FIG. 1A, and is input through a first input terminal IN 1 by an envelope generated by the LPC coefficients extracted by the linear prediction unit 175. An example of the signal multiplied by the multiplier 180 may be a signal 710 illustrated in FIG. 7B.

The gain encoding unit 185 calculates a gain which compensates for a mismatch between the signal multiplied by the multiplier 180 and a low frequency signal of a low frequency band below the preset frequency band, and encodes the gain. By the gain calculated by the gain encoding unit 185, the mismatch between a low frequency signal 720 and the multiplied signal 710 which are illustrated in FIG. 7B may be compensated for as illustrated in FIG. 7C by the decoder. Also, the gain encoded by the gain encoding unit 185 is output to the multiplexing unit 165 illustrated in FIG. 1A through a second output terminal OUT 2.

The noise information encoding unit 190 selects a frequency band of the excitation spectrum generated by the excitation spectrum generation unit 155, which is to be used to generate noise of the frequency band determined to be encoded in the frequency domain by the domain selection unit 170, and encodes information on the selected frequency band. The information encoded by the noise information encoding unit 190 is output to the multiplexing unit 165 illustrated in FIG. 1A through a third output terminal OUT 3.

The envelope information encoding unit 195 extracts envelope information of a spectrum of the frequency band determined to be encoded in the frequency domain by the domain selection unit 170 from a high frequency band above the preset frequency band, and encodes the envelope information. The envelope information encoded by the envelope information encoding unit 195 is output to the multiplexing unit 165 illustrated in FIG. 1A through a fourth output terminal OUT 4.

The present invention is not limited to an open-loop method in which an encoding domain is firstly selected and then encoding is performed in accordance with the selected domain as described above with reference to FIGS. 1A and 1B. Alternatively, a close-loop method in which encoding is performed both in the time domain and in the frequency domain and then more appropriate domain is selected later by comparing encoding results may be used.

Figure 2A:
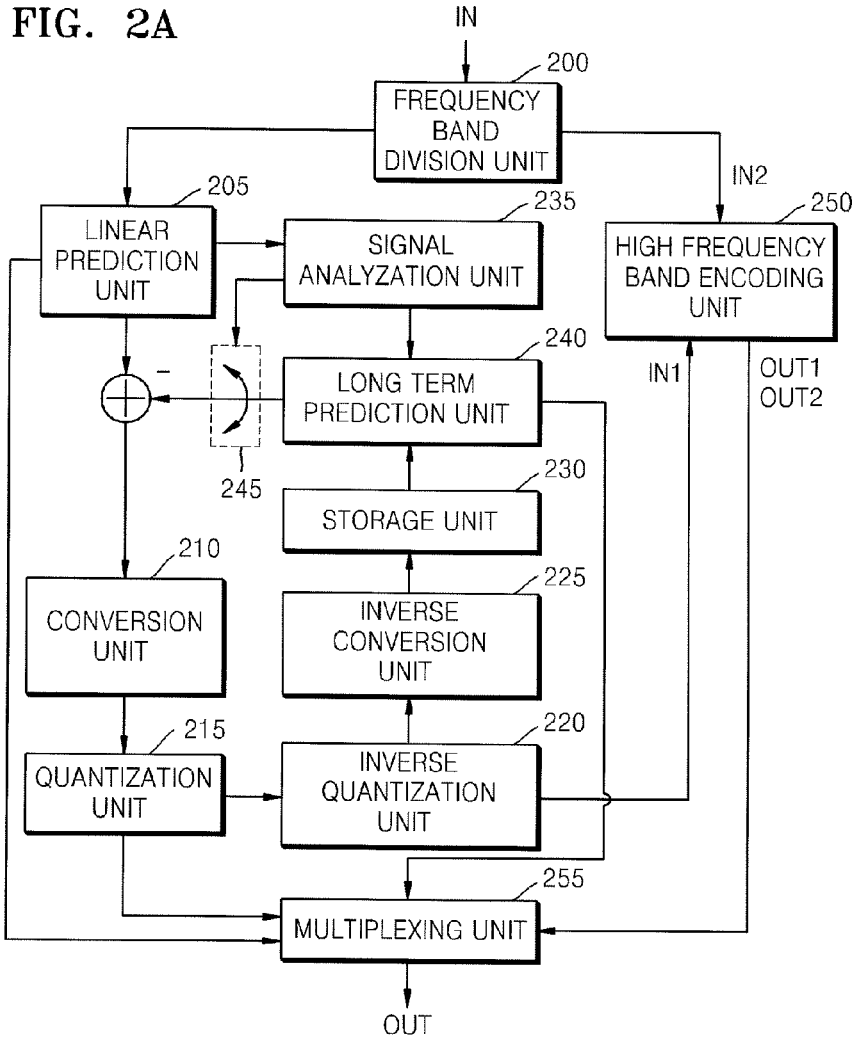
FIG. 2A is a block diagram of an apparatus for adaptively encoding a high frequency band, according to another embodiment of the present invention.

FIG. 2A is a block diagram of an apparatus for adaptively encoding a high frequency band, according to another embodiment of the present invention.

Referring to FIG. 2A, the apparatus includes a frequency band division unit 200, a linear prediction unit 205, a conversion unit 210, a quantization unit 215, an inverse quantization unit 220, an inverse conversion unit 225, a storage unit 230, a signal analyzation unit 235, a long term prediction unit 240, a switching unit 245, a high frequency band encoding unit 250, and a multiplexing unit 255.

The frequency band division unit 200 divides a signal input through an input terminal IN into a low frequency signal of a low frequency band below a preset frequency band and a high frequency signal of a high frequency band above the preset frequency band.

The linear prediction unit 205 extracts LPC coefficients by performing an LPC analysis on the low frequency signal divided by the frequency band division unit 200, and extracts a first excitation signal by removing short term correlations from the low frequency signal. Also, the linear prediction unit 205 encodes the LPC coefficients and outputs the encoded LPC coefficients to the multiplexing unit 255.

The conversion unit 210 generates an excitation spectrum by converting the first excitation signal extracted by the linear prediction unit 205 from the time domain to the frequency domain.

The quantization unit 215 quantizes the excitation spectrum generated by the conversion unit 210. The excitation spectrum quantized by the quantization unit 215 is output to the multiplexing unit 255.

The inverse quantization unit 220 inverse quantizes the excitation spectrum quantized by the quantization unit 215.

The inverse conversion unit 225 performs inverse operation of the conversion performed by the conversion unit 210 by inverse converting the excitation spectrum inverse quantized by the inverse quantization unit 220 from the frequency domain to the time domain, thereby generating a second excitation signal.

The storage unit 230 stores the second excitation signal inverse converted by the inverse conversion unit 225. The storage unit 230 stores the second excitation signal in order to use the second excitation signal when the long term prediction unit 240 performs long term prediction on a signal of a frequency band to be encoded in the time domain from a next frame.

The signal analyzation unit 235 analyzes the first excitation signal extracted by the linear prediction unit 205 and determines whether to perform long tem prediction by the long term prediction unit 240 or not in accordance with characteristics of the low frequency signal. Here, the characteristics of the low frequency signal may be an LPC gain, spectral variations between linear prediction filters of neighboring frames, a pitch delay gain, a long term prediction gain, etc.

If the signal analyzation unit 235 determines to perform the long term prediction on the first excitation signal, the long term prediction unit 240 extracts a third excitation signal by performing the long term prediction on the first excitation signal extracted by the linear prediction unit 205. The long term prediction unit 240 may perform the long term prediction, for example, by measuring continuity of periodicity, a frequency spectral tilt, or a frame energy. Here, the continuity of periodicity may be a degree of continuity of frames which have low variations of pitch lags and high pitch correlations over a certain section. Also, the continuity of periodicity may be a degree of continuity of frames which have very low first formant frequencies and high pitch correlations over a certain section.

The switching unit 245 switches the third excitation signal extracted by the long term prediction unit 240 in accordance with the determination of the signal analyzation unit 235.

The high frequency band encoding unit 250 encodes the high frequency signal in the frequency domain by using the excitation spectrum of the low frequency band below the preset frequency band, which is inverse quantized by the inverse quantization unit 220.

The multiplexing unit 255 generates a bitstream by multiplexing the LPC coefficients encoded by the linear prediction unit 205, the excitation spectrum quantized by the quantization unit 215, the result of the long term prediction performed by the long term prediction unit 240, the result encoded by the high frequency band encoding unit 250, etc. The bitstream is output through an output terminal OUT.

Figure 2B:
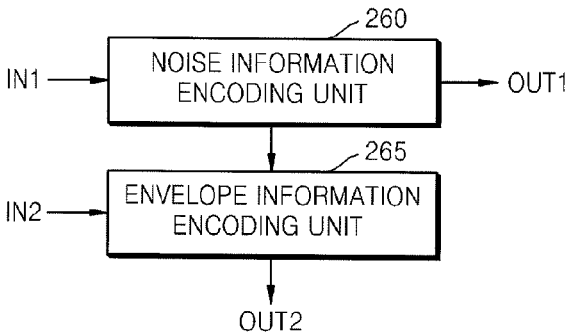
FIG. 2B is a block diagram of a high frequency band encoding unit 250 included in the apparatus illustrated in FIG. 2A, according to an embodiment of the present invention.

FIG. 2B is a block diagram of the high frequency band encoding unit 250 included in the apparatus illustrated in FIG. 2A, according to an embodiment of the present invention.

Referring to FIG. 2B, the high frequency band encoding unit 250 includes a noise information encoding unit 260 and an envelope information encoding unit 265.

The noise information encoding unit 260 encodes information on a frequency band to be used to encode a high frequency spectrum of a high frequency band above a preset frequency band from an excitation spectrum which is inverse quantized by the inverse quantization unit 220 illustrated in FIG. 2A, and are input through a first input terminal IN 1. The information encoded by the noise information encoding unit 260 is output to the multiplexing unit 255 illustrated in FIG. 2A through a first output terminal OUT 1.

The envelope information encoding unit 265 receives a high frequency spectrum through a second input terminal IN 2, extracts an envelope of the high frequency spectrum, and encodes information on the extracted envelope. The envelope information may be energy values calculated by frequency bands. The envelope information encoding unit 265 output the envelope information to the multiplexing unit 255 illustrated in FIG. 2A through a second output terminal OUT 2.

Figure 3A:
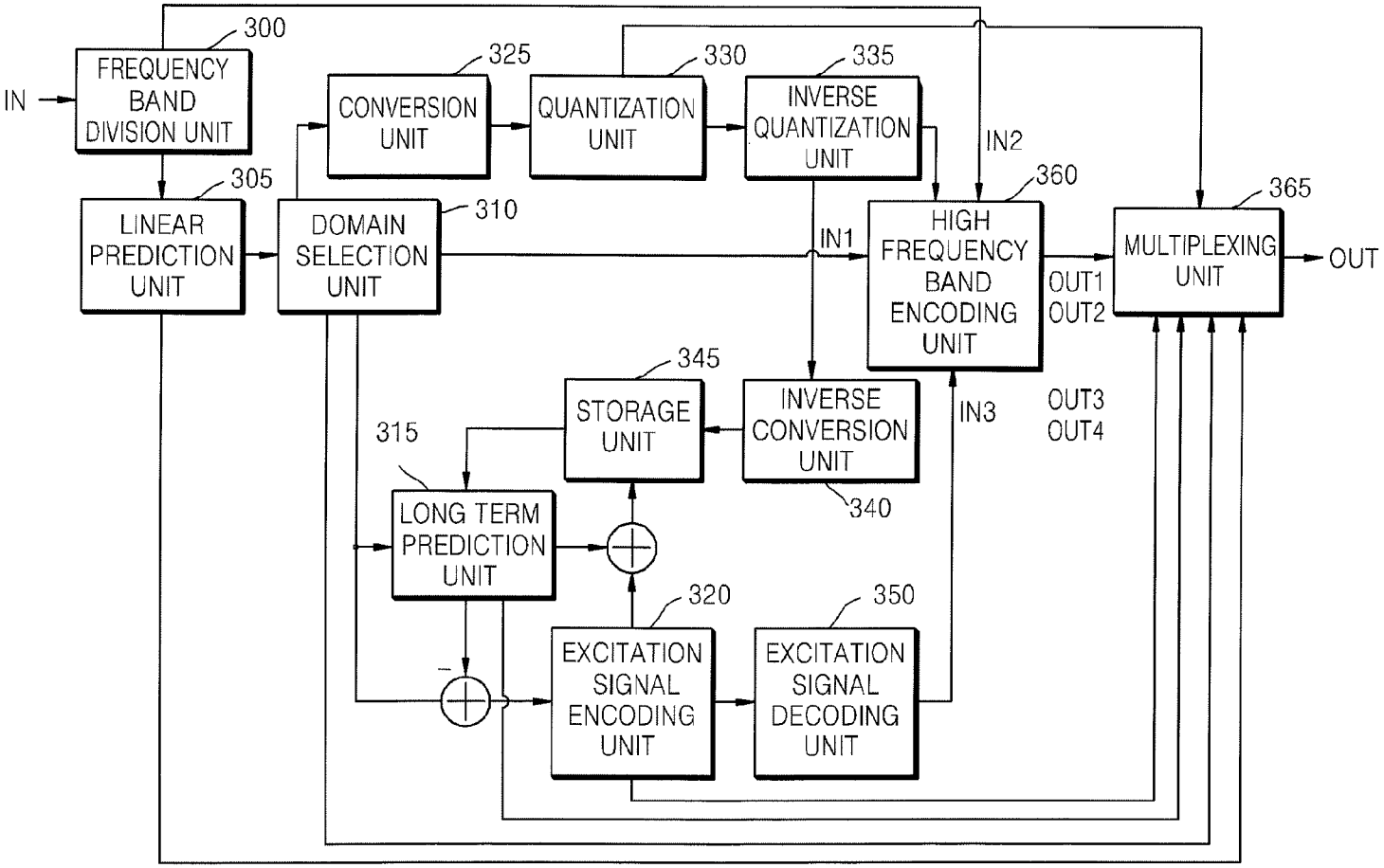
FIG. 3A is a block diagram of an apparatus for adaptively encoding a high frequency band, according to another embodiment of the present invention.

FIG. 3A is a block diagram of an apparatus for adaptively encoding a high frequency band, according to another embodiment of the present invention.

Referring to FIG. 3A, the apparatus includes a frequency band division unit 300, a linear prediction unit 305, a domain selection unit 310, a long term prediction unit 315, an excitation signal encoding unit 320, a conversion unit 325, a quantization unit 330, an inverse quantization unit 335, an inverse conversion unit 340, a storage unit 345, an excitation signal decoding unit 350, a high frequency band encoding unit 360, and a multiplexing unit 365.

The frequency band division unit 300 divides a signal input through an input terminal IN into a low frequency signal of a low frequency band below a preset frequency band and a high frequency signal of a high frequency band above the preset frequency band.

The linear prediction unit 305 extracts LPC coefficients by performing an LPC analysis on the low frequency signal divided by the frequency band division unit 300, and extracts a first excitation signal by removing short term correlations from the low frequency signal. The LPC coefficients extracted by the linear prediction unit 305 are encoded and output to the multiplexing unit 365.

The domain selection unit 310 determines whether to encode the first excitation signal extracted by the linear prediction unit 305 in the time domain or in the frequency domain in accordance with a preset standard. Here, the preset standard may be an LPC gain, spectral variations between linear prediction filters of neighboring frames, a pitch delay gain, a long term prediction gain, etc.

If the domain selection unit 310 determines to encode the first excitation signal in the time domain, the long term prediction unit 315 performs the long term prediction on the first excitation signal extracted by the linear prediction unit 305 and extracts a second excitation signal.

The long term prediction unit 315 may perform the long term prediction, for example, by measuring continuity of periodicity, frequency spectral tilt, or frame energies. Here, the continuity of periodicity may be a degree of continuity of frames which have low variations of pitch lags and high pitch correlations over a certain section. Also, the continuity of periodicity may be a degree of continuity of frames which have very low first formant frequencies and high pitch correlations over a certain section.

The excitation signal encoding unit 320 encodes the second excitation signal extracted by the long term prediction unit 315.

If the domain selection unit 310 determines to encode the first excitation signal in the frequency domain, the conversion unit 325 generates a spectrum by converting the first excitation signal extracted by the linear prediction unit 305 from the time domain to the frequency domain.

The quantization unit 330 quantizes the excitation spectrum generated by the conversion unit 325. The excitation spectrum quantized by the quantization unit 330 is output to the multiplexing unit 365.

The inverse quantization unit 335 inverse quantizes the excitation spectrum quantized by the quantization unit 330.

The inverse conversion unit 340 performs inverse operation of the conversion performed by the conversion unit 325 by inverse converting the excitation spectrum inverse quantized by the inverse quantization unit 335 from the frequency domain to the time domain.

The storage unit 345 stores the third excitation signal inverse converted by the inverse conversion unit 340. The storage unit 345 stores the third excitation signal in order to use the third excitation signal when the long term prediction unit 315 performs the long term prediction on a signal of a frequency band to be encoded in the time domain from a next frame.

The excitation signal decoding unit 350 decodes the second excitation signal encoded by the excitation signal encoding unit 320.

The high frequency band encoding unit 360 adaptively encodes a high frequency signal of a high frequency band above the preset frequency band in the time domain or in the frequency domain by using a signal or spectrum of the low frequency band below the preset frequency band. If the high frequency band encoding unit 360 encodes the high frequency signal in the time domain, the second excitation signal decoded by the excitation signal decoding unit 350 is used, and if the high frequency band encoding unit 360 encodes the high frequency signal in the frequency domain, the excitation spectrum inverse quantized by the inverse quantization unit 335 is used.

The multiplexing unit 365 generates a bitstream by multiplexing the LPC coefficients extracted by the linear prediction unit 305, the result of the long term prediction performed by the long term prediction unit 315, the information on the encoding domain of the low frequency signal selected by the domain selection unit 305, the second excitation signal encoded by the excitation signal encoding unit 320, the excitation spectrum quantized by the quantization unit 330, the result encoded by the high frequency band encoding unit 360, etc. The bitstream is output through an output terminal OUT.

Figure 3B:
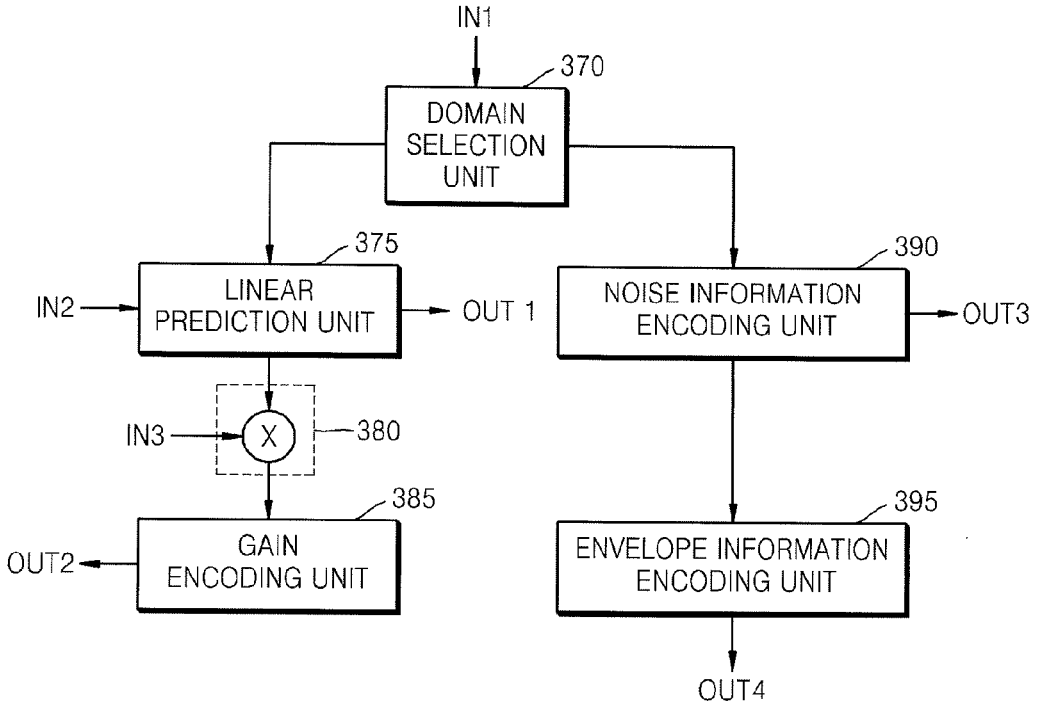
FIG. 3B is a block diagram of a high frequency band encoding unit 360 included in the apparatus illustrated in FIG. 3A, according to an embodiment of the present invention.

FIG. 3B is a block diagram of the high frequency band encoding unit 360 included in the apparatus illustrated in FIG. 3A, according to an embodiment of the present invention.

Referring to FIG. 3B, the high frequency band encoding unit 360 includes a domain selection unit 370, a linear prediction unit 375, a multiplier 380, a gain encoding unit 385, a noise information encoding unit 390, and an envelope information encoding unit 395.

The domain selection unit 370 determines whether to encode a high frequency signal of a high frequency band above a preset frequency band in the time domain or in the frequency domain in accordance with an encoding domain of a low frequency signal of a low frequency band below the preset frequency band, the low frequency signal input through a first input terminal IN 1, the encoding domain selected by the domain selection unit 310 illustrated in FIG. 3A. If the low frequency signal is determined to be encoded in the frequency domain by the domain selection unit 310 illustrated in FIG. 3A, the domain selection unit 370 determines to encode the high frequency signal in the frequency domain, and if the low frequency signal is determined to be encoded in the time domain by the domain selection unit 310 illustrated in FIG. 3A, the domain selection unit 370 determines to encode the high frequency signal in the time domain.

If the high frequency signal is determined to be encoded in the time domain by the domain selection unit 370, the linear prediction unit 375 extracts LPC coefficients by performing an LPC analysis on the high frequency signal input through a second input terminal IN 2. The LPC coefficients extracted by the linear prediction unit 375 are encoded and output to the multiplexing unit 365 illustrated in FIG. 3A through a first output terminal OUT 1, and are used to restore an envelope as illustrated in FIG. 7A by a decoder.

The multiplier 380 multiplies the second excitation signal which is decoded by the excitation signal decoding unit 350 illustrated in FIG. 3A, and is input through a third input terminal IN 3 by an envelope of the high frequency signal generated by the LPC coefficients extracted by the linear prediction unit 375. An example of the signal multiplied by the multiplier 380 may be the signal 710 illustrated in FIG. 7B.

The gain encoding unit 385 calculates a gain which compensates for a mismatch between the signal multiplied by the multiplier 380 and a low frequency signal, and encodes the gain. The mismatch existing at the boundary between the low frequency signal 720 and the multiplied signal 710 which are illustrated in FIG. 7B is compensated for as illustrated in FIG. 7C. Also, the gain encoded by the gain encoding unit 385 is output to the multiplexing unit 365 illustrated in FIG. 3A through a second output terminal OUT 2.

The noise information encoding unit 390 selects a frequency band to be used to decode a high frequency spectrum from the excitation spectrum inverse quantized by the inverse quantization unit 335 illustrated in FIG. 3A by the decoder, and encodes information on the selected frequency band. The information encoded by the noise information encoding unit 390 is output through a third output terminal OUT 3.

The envelope information encoding unit 395 extracts envelope information of the high frequency spectrum, and encodes the envelope information. The envelope information may be energy values calculated by frequency bands. The envelope information encoded by the envelope information encoding unit 395 is output to the multiplexing unit 365 illustrated in FIG. 3A through a fourth output terminal OUT 4.

The present invention is not limited to an open-loop method in which an encoding domain is firstly selected and then encoding is performed in accordance with the selected domain as described above with reference to FIGS. 3A and 3B. Alternatively, a close-loop method in which encoding is performed both in the time domain and in the frequency domain and then more appropriate domain is selected later by comparing encoding results may be used.

Figure 4A:
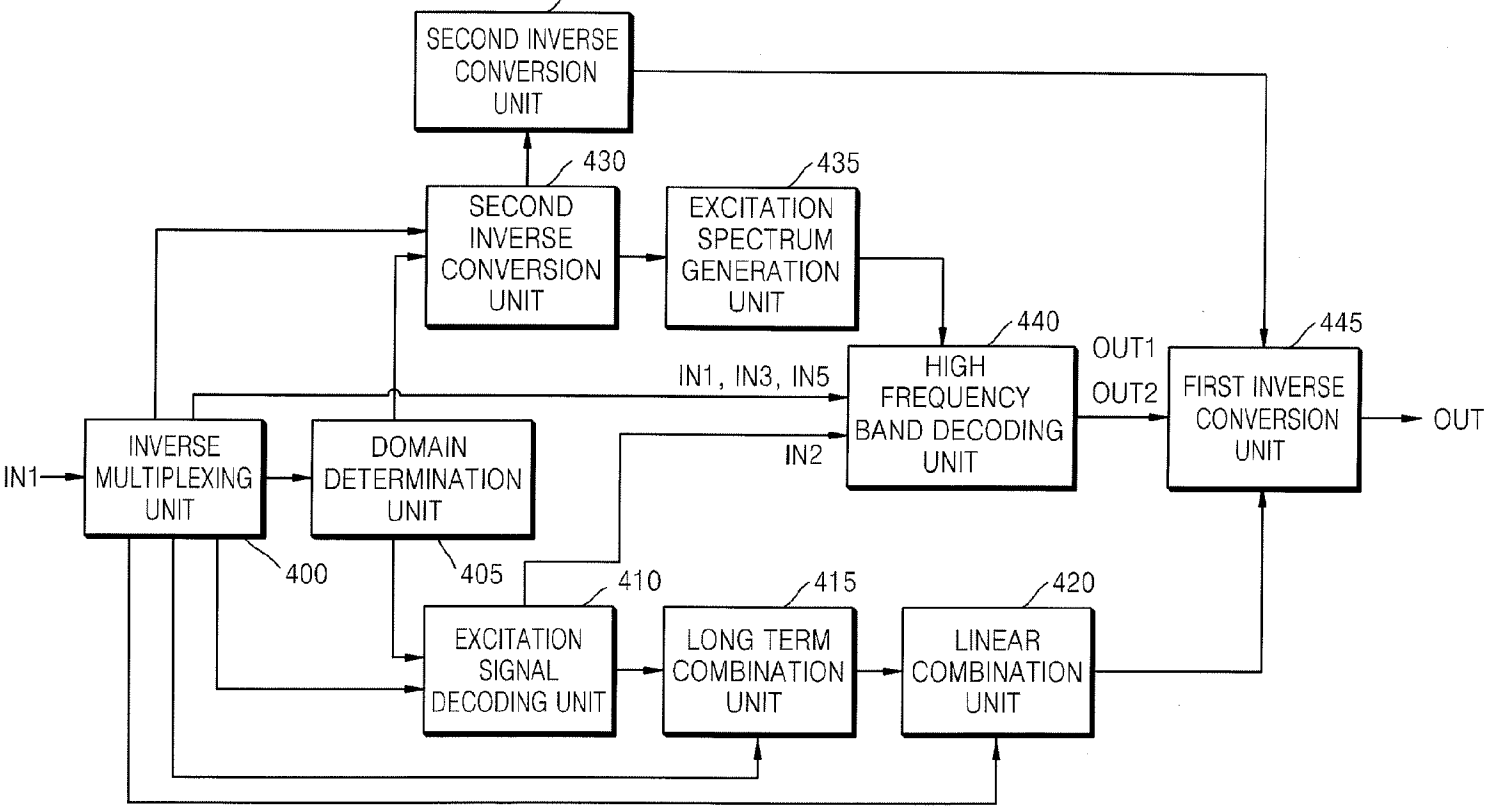
FIG. 4A is a block diagram of an apparatus for adaptively decoding a high frequency band, according to an embodiment of the present invention.

FIG. 4A is a block diagram of an apparatus for adaptively decoding a high frequency band, according to an embodiment of the present invention.

Referring to FIG. 4A, the apparatus includes an inverse multiplexing unit 400, a domain determination unit 405, an excitation signal decoding unit 410, a long term combination unit 415, a linear combination unit 420, an inverse quantization unit 430, a second inverse conversion unit 433, an excitation spectrum generation unit 435, a high frequency band decoding unit 440, and a first inverse conversion unit 445.

The inverse multiplexing unit 400 inverse multiplexes a bitstream input from an encoder through an input terminal IN. The inverse multiplexing unit 400 inverse multiplexes information on an encoding domain of a frequency band encoded by the encoder, LPC coefficients encoded by the encoder, a result of long term prediction performed by the encoder, an excitation signal encoded by the encoder, a spectrum quantized by the encoder, information required for decoding a high frequency signal by using a low frequency signal or a low frequency spectrum, etc.

The domain determination unit 405 receives the information on the encoding domain of a low frequency band below a preset frequency band, which is encoded by the encoder, and determines the encoding domain of each frequency band.

The excitation signal decoding unit 410 receives the excitation signal of a frequency band determined as having been encoded in the time domain by the domain determination unit 405, the excitation signal encoded by the encoder, from the inverse multiplexing unit 400 and decodes the excitation signal.

The long term combination unit 415 receives the result of the long term prediction performed by the encoder on the frequency band determined as having been encoded in the time domain by the domain determination unit 405 from the inverse multiplexing unit 400, decodes the result, and combines the excitation signal decoded by the excitation signal decoding unit 410 and the result of the long term prediction.

The linear combination unit 420 receives the LPC coefficients of the frequency band determined as having been encoded in the time domain by the domain determination unit 405 from the inverse multiplexing unit 400, decodes the LPC coefficients, and combines the LPC coefficients and the signal combined by the long term combination unit 415.

The inverse quantization unit 430 receives the spectrum of the frequency band determined as having been encoded in the frequency domain by the domain determination unit 405 from the inverse multiplexing unit 400, and inverse quantizes the spectrum.

The second inverse conversion unit 433 performs inverse operation of the conversion performed by the second conversion unit 125 illustrated in FIG. 1A by inverse converting the spectrum inverse quantized by the inverse quantization unit 430 from the frequency domain to the time domain.

The excitation spectrum generation unit 435 generates an excitation spectrum by whitening the spectrum inverse quantized by the inverse quantization unit 430.

The high frequency band decoding unit 440 decodes a high frequency signal of a high frequency band above the preset frequency band by using the excitation signal decoded by the excitation signal decoding unit 410 or the excitation spectrum generated by the excitation spectrum generation unit 435.

The first inverse conversion unit 445 performs inverse operation of the conversion performed by the first conversion unit 100 illustrated in FIG. 1A. The first inverse conversion unit 445 performs inverse conversion by combining the signal combined by the linear combination unit 420 or the spectrum inverse converted by the second inverse conversion unit 433 and the high frequency signal decoded by the high frequency band decoding unit 440 into a time domain signal, and outputs the combined time domain signal through an output terminal OUT. The first inverse conversion unit 445 may perform the inverse conversion by using a QMF method or an LOT method.

However, the first inverse conversion unit 445 may combine a time domain signal and a frequency domain signal by frequency bands into a time domain signal by using, for example, a FV-MLT method. In this case, the high frequency band decoding unit 440 may not include an additional inverse conversion unit in order to convert a frequency domain signal into a time domain signal.

Figure 4B:
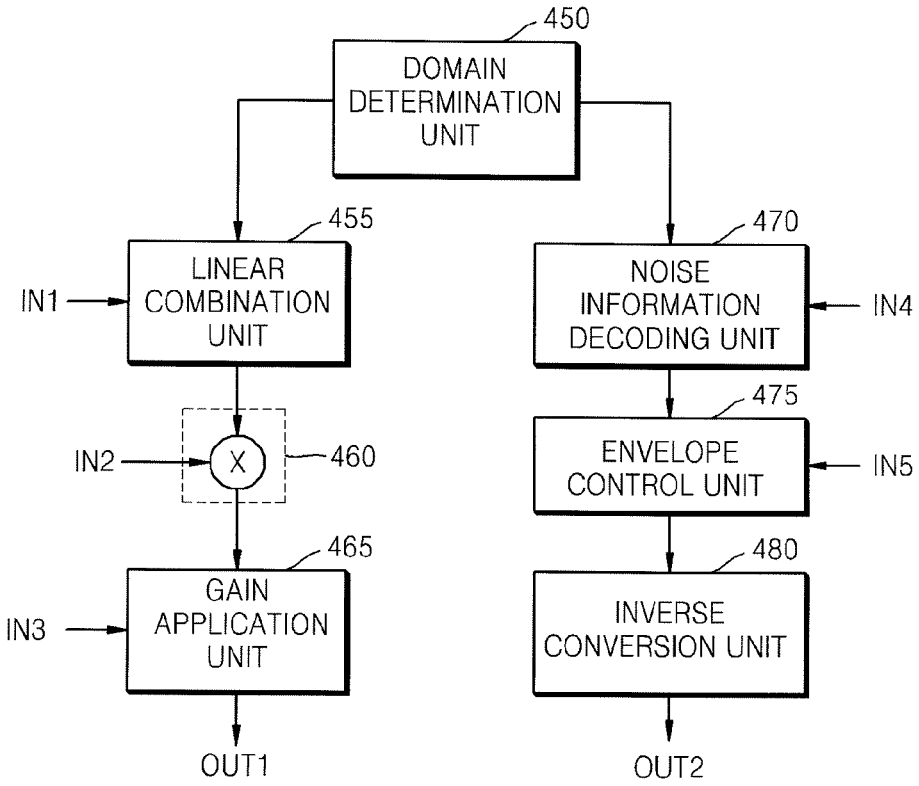
FIG. 4B is a block diagram of a high frequency band decoding unit 440 included in the apparatus illustrated in FIG. 4A, according to an embodiment of the present invention.

FIG. 4B is a block diagram of the high frequency band decoding unit 440 included in the apparatus illustrated in FIG. 4A, according to an embodiment of the present invention.

Figure 8A:
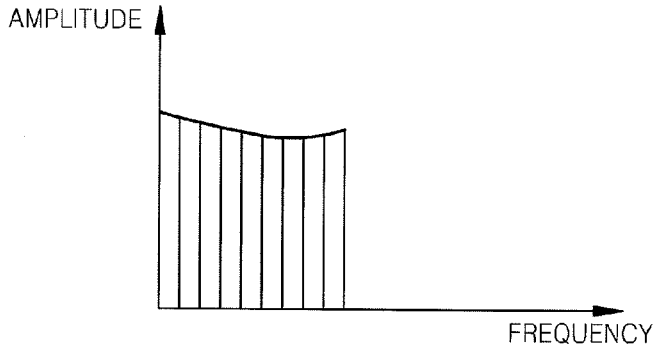
FIG. 8A is a graph of an excitation spectrum of a low frequency band, according to an embodiment of the present invention.

FIG. 8A is a graph of an excitation spectrum of a low frequency band, according to an embodiment of the present invention.

Figure 8B:
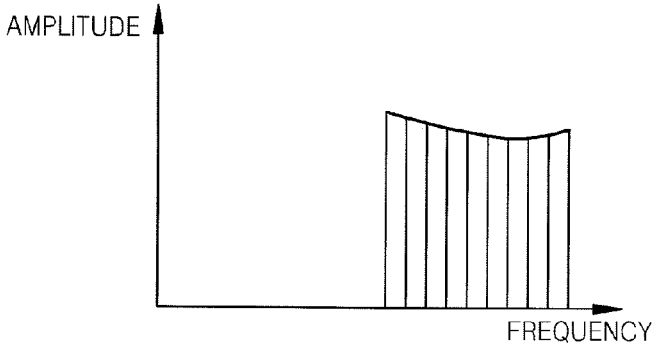
FIG. 8B is a graph of an excitation spectrum of a low frequency band when the excitation spectrum is patched to a high frequency band, according to an embodiment of the present invention.

FIG. 8B is a graph of an excitation spectrum of a low frequency band when the excitation spectrum is patched to a high frequency band, according to an embodiment of the present invention.

Figure 8C:
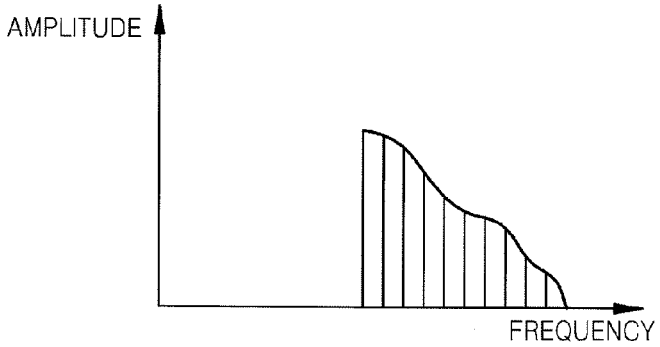
FIG. 8C is a graph of a controlled envelope of a high frequency spectrum, according to an embodiment of the present invention.

FIG. 8C is a graph of a controlled envelope of a high frequency spectrum, according to an embodiment of the present invention.

Referring of FIG. 4B, the high frequency band decoding unit 440 includes a domain determination unit 450, a linear combination unit 455, a multiplier 460, a gain application unit 465, a noise information decoding unit 470, an envelope control unit 475, and an inverse conversion unit 480.

The domain determination unit 450 determines whether a signal of a high frequency band above a preset frequency band has been encoded in the time domain or in the frequency domain. An encoding domain of each frequency band may be determined by using information on an encoding domain, which is transmitted from an encoder and is received through the inverse multiplexing unit 400 illustrated in FIG. 4A or by using information on a decoded domain of a low frequency band below the preset frequency band, which is used when the high frequency band is decoded and is received from the domain determination unit 405 illustrated in FIG. 4A.

The linear combination unit 455 receives LPC coefficients of a frequency band determined as having been encoded in the time domain from the inverse multiplexing unit 400 through a first input terminal IN 1, and decodes the LPC coefficients. By the LPC coefficients decoded by the linear combination unit 455, an envelope may be restored as illustrated in FIG. 7A.

The multiplier 460 multiplies the excitation signal which is decoded by the excitation signal decoding unit 410 illustrated in FIG. 4A, and are input through a second input terminal IN 2 by an envelope generated by the LPC coefficients decoded by the linear combination unit 455. An example of the signal multiplied by the multiplier 460 may be the signal 710 illustrated in FIG. 7B.

The gain application unit 465 decodes the gain received through a third input terminal IN 3 and applies the gain to the signal multiplied by the multiplier 460. By applying the gain, a mismatch between a decoded low frequency signal and a decoded high frequency signal may be compensated for. For example, the high frequency signal multiplied by the multiplier 460 has the mismatch at the boundary to the low frequency signal as illustrated in FIG. 7B. However, when the gain application unit 465 applies the gain, the mismatch does not exist between the low frequency signal and the high frequency signal as illustrated in FIG. 7C. The signal to which the gain is applied to by the gain application unit 465 is output to the first inverse conversion unit 445 illustrated in FIG. 4A through a first output terminal OUT 1.

The noise information decoding unit 470 receives information on a frequency band to be used to decode a high frequency spectrum from the excitation spectrum generated by the excitation spectrum generation unit 435 illustrated in FIG. 4A from the inverse multiplexing unit 400 illustrated in FIG. 4A through a fourth input terminal IN 4, and decodes the information. The noise information decoding unit 470 generates noise by patching or symmetrically folding the excitation spectrum of the corresponding frequency band to the frequency band determined to be encoded in the frequency domain by the domain determination unit 450. For example, an excitation spectrum illustrated in FIG. 8A is patched to the high frequency band as illustrated in FIG. 8B.

The envelope control unit 475 receives envelope information of a high frequency spectrum encoded by the encoder from the inverse multiplexing unit 400 illustrated in FIG. 4A through a fifth input terminal IN 5, and decodes the envelope information. An envelope of the noise generated by the noise information decoding unit 470 is controlled by using the envelope information of the high frequency spectrum decoded by the envelope control unit 475. For example, the envelope control unit 475 controls the noise generated by the noise information decoding unit 470 as illustrated in FIG. 8B into an envelope illustrated in FIG. 8C by using the envelope information of the high frequency spectrum.

The inverse conversion unit 480 performs inverse operation of the conversion performed by the second conversion unit 125 illustrated in FIG. 1A by inverse converting the noise of which envelope is controlled by the envelope control unit 475 from the frequency domain to the time domain, thereby generating a high frequency signal.

Figure 5A:
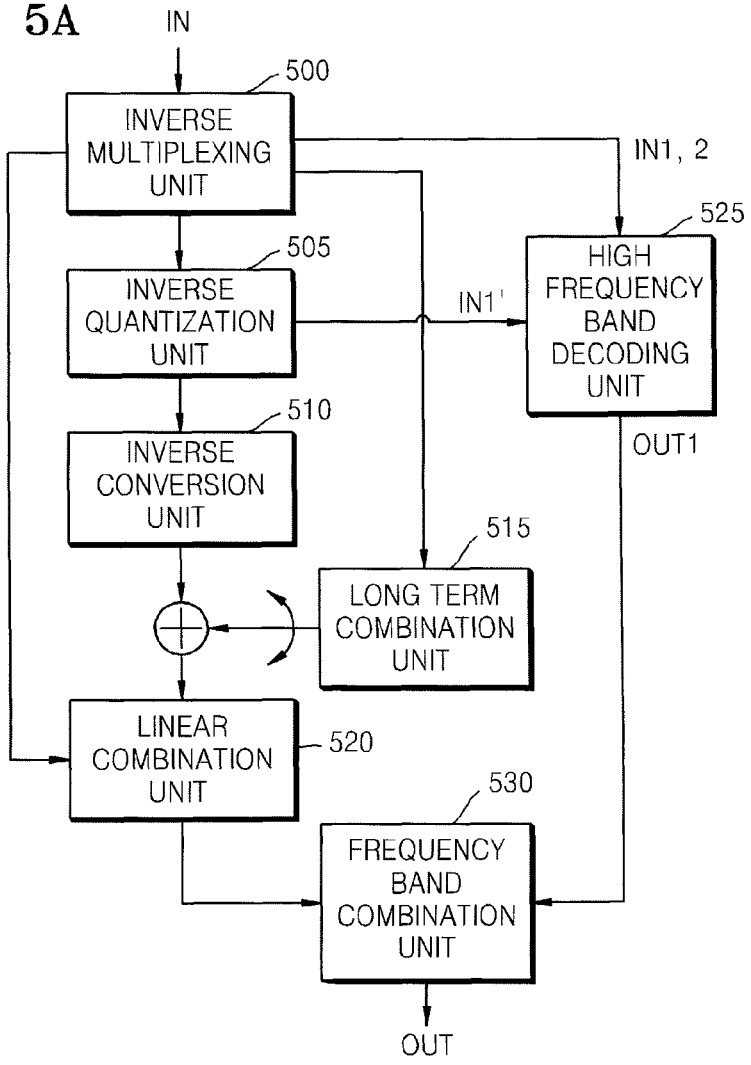
FIG. 5A is a block diagram of an apparatus for adaptively decoding a high frequency band, according to another embodiment of the present invention.

FIG. 5A is a block diagram of an apparatus for adaptively decoding a high frequency band, according to another embodiment of the present invention.

Referring to FIG. 5A, the apparatus includes an inverse multiplexing unit 500, an inverse quantization unit 505, an inverse conversion unit 510, a long term combination unit 515, a linear combination unit 520, a high frequency band decoding unit 525, and a frequency band combination unit 530.

The inverse multiplexing unit 500 inverse multiplexes a bitstream input from an encoder through an input terminal IN. The inverse multiplexing unit 500 inverse multiplexes LPC coefficients encoded by the encoder, an excitation spectrum encoded by the encoder, a result of long term prediction performed by the encoder, information required for decoding a high frequency signal of a high frequency band above a preset frequency band by using an excitation spectrum of a low frequency band below the preset frequency band, etc.

The inverse quantization unit 505 receives the low frequency excitation spectrum quantized by the encoder from the inverse multiplexing unit 500 and inverse quantizes the low frequency excitation spectrum.

The inverse conversion unit 510 performs inverse operation of the conversion performed by the conversion unit 210 illustrated in FIG. 2A by inverse converting the excitation spectrum inverse quantized by the inverse quantization unit 505 from the frequency domain to the time domain, thereby generating an excitation signal.

The long term combination unit 515 receives the result of the long term prediction performed by the encoder on the low frequency excitation signal from the inverse multiplexing unit 500, decodes the result, and selectively combines the excitation signal generated by the inverse conversion unit 510 and the result of the long term prediction.

The linear combination unit 520 receives the LPC coefficients from the inverse multiplexing unit 500, and decodes the LPC coefficients. After the LPC coefficients are decoded, if the long term combination unit 515 did not combine the result of the long term prediction, the linear combination unit 520 combines the excitation signal generated by the inverse conversion unit 510 and the LPC coefficients, and if the long term combination unit 515 combined the result of the long term prediction, the linear combination unit 520 combines the signal combined by the long term combination unit 515 and the LPC coefficients. The signal combined by the linear combination unit 520 is a restored low frequency signal of a low frequency band.

The high frequency band decoding unit 525 decodes a high frequency signal by using the excitation spectrum of the low frequency signal inverse quantized by the inverse quantization unit 505.

The frequency band combination unit 530 combines the low frequency signal restored by the linear combination unit 520 and the high frequency signal decoded by the high frequency band decoding unit 525, and outputs the combined signal through an output terminal OUT.

Figure 5B:
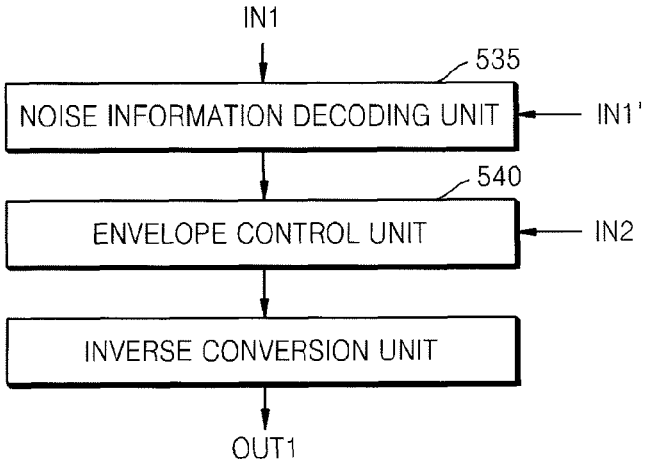
FIG. 5B is a block diagram of a high frequency band decoding unit 525 included in the apparatus illustrated in FIG. 5A, according to an embodiment of the present invention.

FIG. 5B is a block diagram of a high frequency band decoding unit 525 included in the apparatus illustrated in FIG. 5A, according to an embodiment of the present invention.

Referring of FIG. 5B, the high frequency band decoding unit 525 includes a noise information decoding unit 535, an envelope control unit 540, an inverse conversion unit 545.

The noise information decoding unit 535 receives information on a frequency band to be used to decode a high frequency spectrum from an excitation spectrum of a low frequency band below a preset frequency band from the inverse multiplexing unit 500 illustrated in FIG. 5A through a first input terminal IN 1, and decodes the information. The noise information decoding unit 535 selects an excitation spectrum to be used from excitation spectrums inverse quantized by the inverse quantization unit 505 through a first' input terminal IN 1' in accordance with the decoded information, and generates noise by patching or symmetrically folding the corresponding excitation spectrum to a high frequency band above the preset frequency band. For example, the excitation spectrum illustrated in FIG. 8A is patched to the high frequency band as illustrated in FIG. 8B.

The envelope control unit 540 receives envelope information of a high frequency spectrum encoded by the encoder from the inverse multiplexing unit 500 illustrated in FIG. 5A through a second input terminal IN 2, and decodes the envelope information. The envelope control unit 540 controls an envelope of the noise generated by the noise information decoding unit 535 by using the envelope information of the high frequency spectrum. For example, the envelope control unit 540 controls the noise generated by the noise information decoding unit 535 as illustrated in FIG. 8B into an envelope illustrated in FIG. 8C by using the envelope information of the high frequency spectrum.

The inverse conversion unit 545 performs inverse operation of the conversion performed by the conversion unit 210 illustrated in FIG. 2A by inverse converting the noise of which envelope is controlled by the envelope control unit 540 from the frequency domain to the time domain, thereby generating a high frequency signal. The high frequency signal generated by the inverse conversion unit 545 is output to the frequency band combination unit 530 illustrated in FIG. 5A through a first output terminal OUT 1.

Figure 6A:
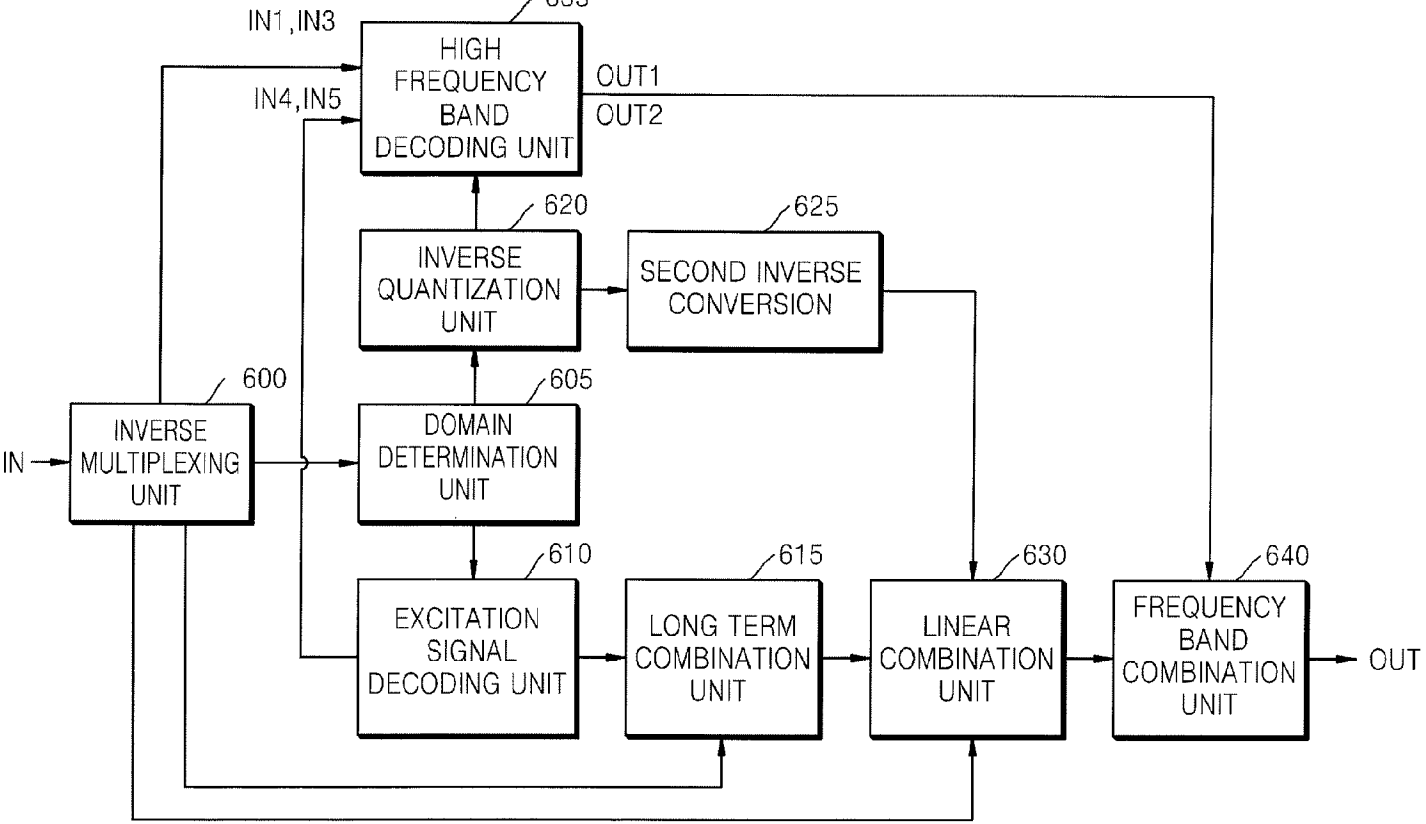
FIG. 6A is a block diagram of an apparatus for adaptively decoding a high frequency band, according to another embodiment of the present invention.

FIG. 6A is a block diagram of an apparatus for adaptively decoding a high frequency band, according to another embodiment of the present invention.

Referring to FIG. 6A, the apparatus includes an inverse multiplexing unit 600, a domain determination unit 605, an excitation signal decoding unit 610, a long term combination unit 615, an inverse quantization unit 620, an inverse conversion unit 625, a linear combination unit 630, a high frequency band decoding unit 635, and a frequency band combination unit 640.

The inverse multiplexing unit 600 inverse multiplexes a bitstream input from an encoder through an input terminal IN. The inverse multiplexing unit 600 inverse multiplexes information on an encoding domain of a low frequency signal selected by the encoder, LPC coefficients encoded by the encoder, a result of long term prediction performed by the encoder, an excitation spectrum quantized by the encoder, information required for decoding a high frequency signal by using a low frequency signal or a low frequency spectrum of a low frequency band below a preset frequency band, etc.

The domain determination unit 605 receives the information on the encoding domain of the low frequency band encoded by the encoder from the inverse multiplexing unit 600, decodes the information on the encoding domain, and determines whether the low frequency band has been encoded in the time domain or in the frequency domain.

If the domain determination unit 605 determines that the low frequency band has been encoded in the time domain, the excitation signal decoding unit 610 receives an excitation signal of the low frequency band encoded by the encoder from the inverse multiplexing unit 600 and decodes the excitation signal.

The long term combination unit 615 receives the result of the long term prediction performed by the encoder on the low frequency band signal from the inverse multiplexing unit 600, decodes the result, and combines the excitation signal decoded by the excitation signal decoding unit 610 and the result of the long term prediction.

If the domain determination unit 605 determines that the low frequency band has been encoded in the frequency domain, the inverse quantization unit 620 receives an excitation spectrum quantized by the encoder from the inverse multiplexing unit 600, and inverse quantizes the excitation spectrum.

The inverse conversion unit 625 performs inverse operation of the conversion performed by the conversion unit 325 illustrated in FIG. 3A by inverse converting the excitation spectrum inverse quantized by the inverse quantization unit 620 from the frequency domain to the time domain, thereby generating an excitation signal.

The linear combination unit 630 receives the LPC coefficients of the low frequency signal from the inverse multiplexing unit 600, decodes the LPC coefficients, and combines the decoded LPC coefficients and the excitation signal combined by the long term combination unit 615 or the excitation signal generated by the inverse conversion unit 625. The signal combined by the linear combination unit 630 is a restored low frequency signal of a low frequency band.

The excitation spectrum generation unit 635 decodes the high frequency signal by using the excitation spectrum inverse quantized by the inverse quantization unit 620 or the excitation signal decoded by the excitation signal decoding unit 610. If the low frequency band has been encoded in the time domain, the high frequency band decoding unit 635 decodes the high frequency signal by using the excitation spectrum inverse quantized by the inverse quantization unit 620, and if the low frequency band has been encoded in the frequency domain, the high frequency band decoding unit 635 decodes the high frequency signal by using the excitation spectrum decoded by the excitation signal decoding unit 610.

The frequency band combination unit 640 combines the low frequency signal restored by the linear combination unit 630 and the high frequency signal decoded by the high frequency band decoding unit 525, and outputs the combined signal through a first output terminal OUT.

Figure 6B:
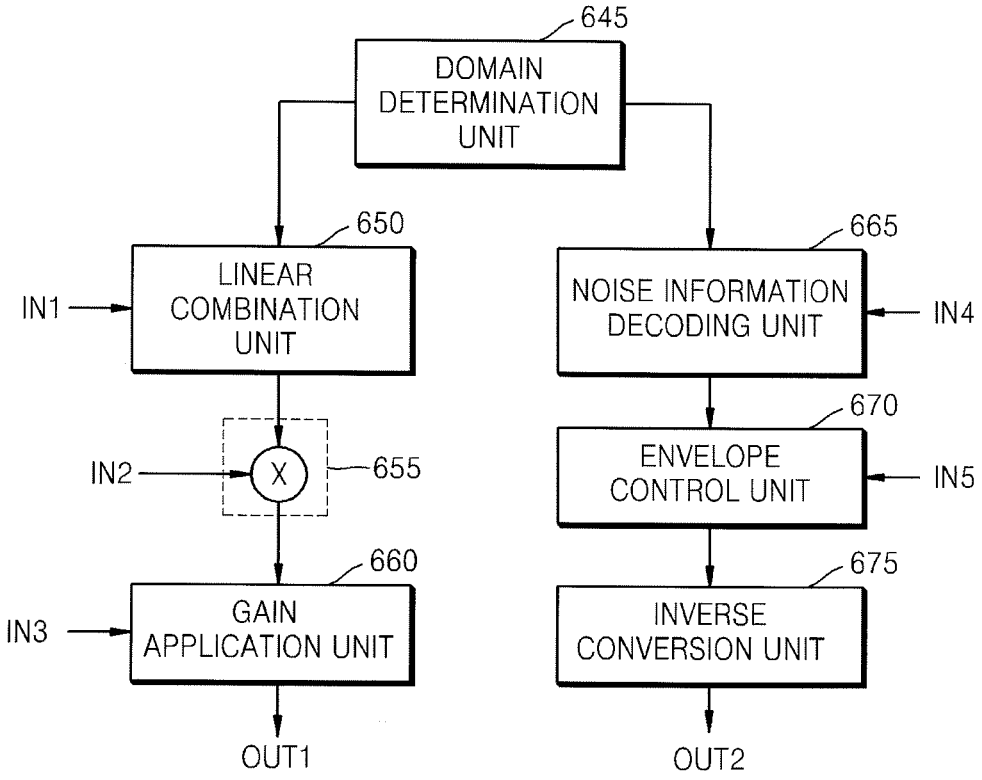
FIG. 6B is a block diagram of a high frequency band decoding unit 635 included in the apparatus illustrated in FIG. 6A, according to an embodiment of the present invention.

FIG. 6B is a block diagram of a high frequency band decoding unit 635 included in the apparatus illustrated in FIG. 6A, according to an embodiment of the present invention.

Referring of FIG. 6B, the high frequency band decoding unit 635 includes a domain determination unit 645, a linear combination unit 650, a multiplier 655, a gain application unit 660, a noise information decoding unit 665, an envelope control unit 670, and an inverse conversion unit 675.

The domain determination unit 645 determines whether to decode a high frequency band above a preset frequency band in the time domain or in the frequency domain by determining an encoding domain of a low frequency band below the preset frequency band.

If the domain determination unit 645 determines to decode the high frequency band in the time domain, the linear combination unit 650 receives LPC coefficients of a high frequency signal from the inverse multiplexing unit 600 illustrated in FIG. 6A through a first input terminal IN 1, and decodes the LPC coefficients. By the LPC coefficients decoded by the linear combination unit 650, an envelope may be restored as illustrated in FIG. 7A.

The multiplier 655 multiplies the excitation signal which is decoded by the excitation signal decoding unit 610 illustrated in FIG. 6A and are input through a second input terminal IN 2 by the envelope generated by the LPC coefficients decoded by the linear combination unit 650. An example of the signal multiplied by the multiplier 655 may be the signal 710 illustrated in FIG. 7B.

The gain application unit 660 decodes a gain received through a third input terminal IN 3 from the inverse multiplexing unit 600 illustrated in FIG. 6A, decodes the gain, and applies the gain to the signal multiplied by the multiplier 655. By applying the gain, a mismatch between a low frequency signal and a high frequency signal, which are restored by the linear combination unit 630 illustrated in FIG. 6A, may be compensated for. For example, the high frequency signal multiplied by the multiplier 655 has the mismatch at the boundary to the low frequency signal as illustrated in FIG. 7B. However, when the gain application unit 660 applies the gain, the mismatch does not exist between the low frequency signal and the high frequency signal as illustrated in FIG. 7C. The signal to which the gain is applied to by the gain application unit 660 is output to the frequency band combination unit 640 illustrated in FIG. 6A through a first output terminal OUT 1.

If the domain determination unit 645 determines to decode the high frequency band in the frequency domain, the noise information decoding unit 665 receives an excitation spectrum inverse quantized by the inverse quantization unit 620 illustrated in FIG. 6A through a fourth input terminal IN 4, and generates a spectrum by patching or symmetrically folding the excitation spectrum to the high frequency band. For example, the excitation spectrum illustrated in FIG. 8A is patched to the high frequency band as illustrated in FIG. 8B.

The envelope control unit 670 receives envelope information of a high frequency spectrum encoded by the encoder from the inverse multiplexing unit 600 illustrated in FIG. 6A through a fifth input terminal IN 5, and decodes the envelope information. The envelope control unit 670 controls an envelope of the noise generated by the noise information decoding unit 665 by using the decoded envelope information of the high frequency spectrum. For example, the envelope control unit 670 controls the noise generated by the noise information decoding unit 665 as illustrated in FIG. 8B into the envelope illustrated in FIG. 8C by using the envelope information of the high frequency spectrum.

The inverse conversion unit 675 performs inverse operation of the conversion performed by the conversion unit 325 illustrated in FIG. 3A by inverse converting the noise of which envelope is controlled by the envelope control unit 670 from the frequency domain to the time domain, thereby generating a high frequency signal.

Figure 9A:
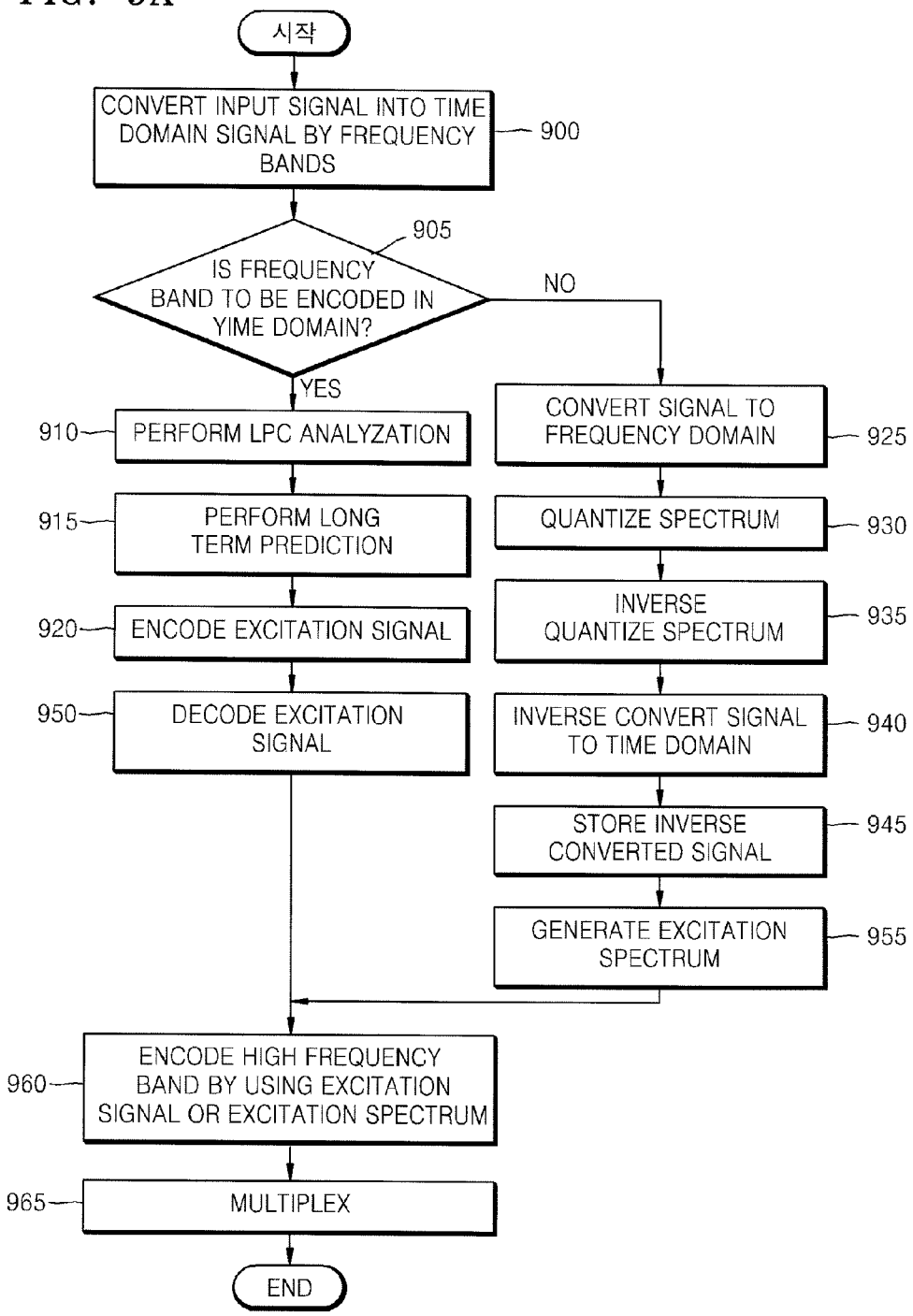
FIG. 9A is a flowchart of a method of adaptively encoding a high frequency band, according to an embodiment of the present invention.

FIG. 9A is a flowchart of a method of adaptively encoding a high frequency band, according to an embodiment of the present invention.

In operation 900, an input signal is converted into a signal of the time domain by frequency bands. The conversion of operation 900 may be performed by using a QMF method or an LOT method.

However, the input signal may be converted into a signal of the time domain and a signal of the frequency domain signal by using, for example, a FV-MLT method in operation 900. In this case, operation 925 may not be performed and the conversion may be performed in operation 900 in a domain selected in operation 905.

In operation 905, whether to encode each signal of a low frequency band below a preset frequency band in the time domain or in the frequency domain is determined from the signal converted in operation 900 in accordance with a preset standard. Here, the preset standard may be an LPC gain, spectral variations between linear prediction filters of neighboring frames, a pitch delay gain, a long term prediction gain, etc.

In operation 910, LPC coefficients are extracted and encoded by performing an LPC analysis on a signal of a frequency band determined to be encoded in the time domain in operation 905, and a first excitation signal is extracted by removing short term correlations from a signal of a frequency band determined to be encoded in the time domain in operation 905.

In operation 915, long term prediction is performed on the extracted first excitation signal and a second excitation signal is extracted.

The long term prediction of operation 915 may be performed by measuring continuity of periodicity, frequency spectral tilt, or frame energies. Here, the continuity of periodicity may be a degree of continuity of frames which have low variations of pitch lags and high pitch correlations over a certain section. Here, the continuity of periodicity may be a degree of continuity of frames which have very low first formant frequencies and high pitch correlations over a certain section.

In operation 920, the second excitation signal extracted in operation 915 is encoded.

In operation 925, a spectrum is generated by converting a signal of a frequency band determined to be encoded in the frequency domain from the time domain to the frequency domain.

In operation 930, the spectrum generated in operation 925 is quantized.

In operation 935, the spectrum quantized in operation 930 is inverse quantized.

In operation 940, inverse operation of the conversion of operation 925 is performed by inverse converting the spectrum inverse quantized in operation 935 from the frequency domain to the time domain.

In operation 945, the signal inverse converted in operation 940 is stored. The inverse converted signal is stored in order to use the inverse converted signal when the long term prediction is performed in operation 915 on a signal of a frequency band to be encoded in the time domain from a next frame.

In operation 950, the second excitation signal encoded in operation 920 is decoded.

In operation 955, an excitation spectrum is generated by whitening the spectrum inverse quantized in operation 935.

In operation 960, a signal of a high frequency band above the preset frequency band is adaptively encoded in the time domain or in the frequency domain by using a signal of a low frequency band below the preset frequency band. If the signal is encoded in the time domain, the second excitation signal decoded in operation 950 is used, and if the signal is encoded in the frequency domain, the excitation spectrum generated in operation 955 is used.

In operation 965, a bitstream is generated by multiplexing the information on the encoding domain of each frequency band which is encoded in operation 905, the LPC coefficients encoded in operation 910, the result of the long term prediction performed in operation 915, the second excitation signal encoded in operation 920, the spectrum quantized in operation 930, and the result encoded in operation 960.

Figure 9B:
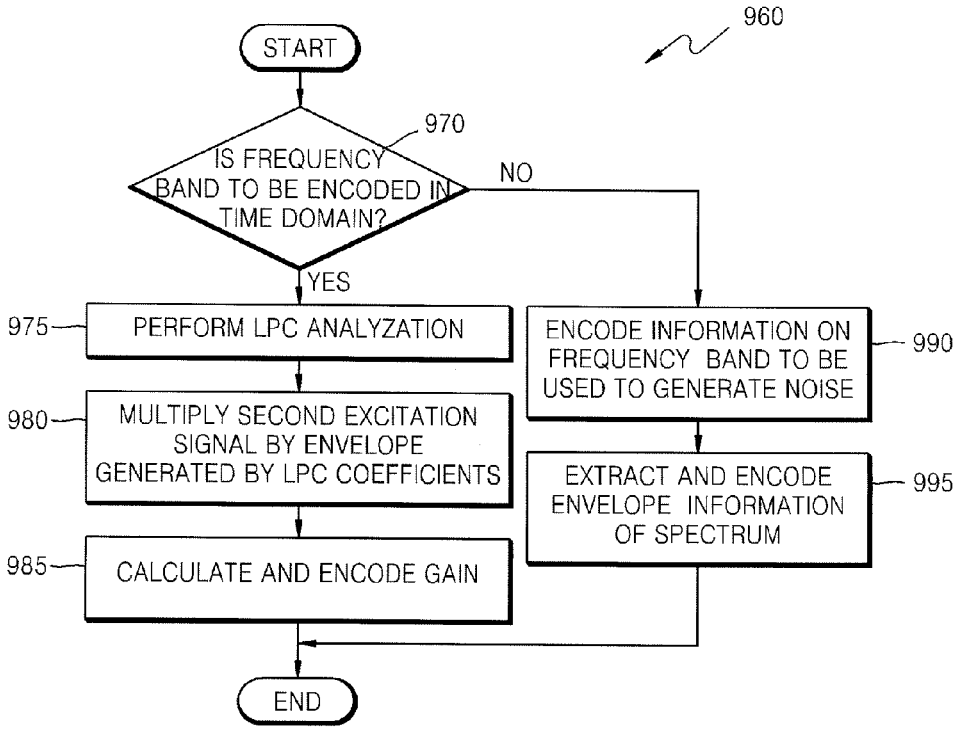
FIG. 9B is a flowchart of operation 960 included in the method of FIG. 9A, according to an embodiment of the present invention.

FIG. 9B is a flowchart of operation 960 included in the method of FIG. 9A, according to an embodiment of the present invention.

In operation 970, whether to encode a signal of a high frequency band above a preset frequency band in the time domain or in the frequency domain is determined.

The determination of operation 970 may be performed in accordance with whether a low frequency band below the preset frequency band, which is used when the high frequency band is encoded, is encoded in the time domain or in the frequency domain. If a low frequency band, which is used when the high frequency band is encoded, is encoded in the time domain, the high frequency band is determined to be encoded in the time domain, and if the low frequency band, which is used when the high frequency band is encoded, is encoded in the frequency domain, the high frequency band is determined to be encoded in the frequency domain.

In operation 975, LPC coefficients are extracted by performing an LPC analysis on the frequency band determined to be encoded in the time domain in operation 970. The LPC coefficients extracted in operation 975 are used to restore an envelope as illustrated in FIG. 7A by a decoder.

In operation 980, the second excitation signal decoded in operation 950 of FIG. 9A is multiplied by an envelope generated by the LPC coefficients extracted in operation 975. An example of the signal multiplied in operation 980 may be a signal 710 illustrated in FIG. 7B.

In operation 985, a gain which compensates for a mismatch between the signal multiplied in operation 980 and a low frequency signal of a low frequency band below the preset frequency band is calculated and encoded. By the gain calculated in operation 985, the mismatch between a low frequency signal 720 and the multiplied signal 710 which are illustrated in FIG. 7B may be compensated for as illustrated in FIG. 7C by the decoder.

In operation 990, a frequency band of the excitation spectrum generated in operation 955, which is to be used to generate noise of the frequency band determined to be encoded in the frequency domain in operation 970 is selected and information on the selected frequency band is encoded.

In operation 995, envelope information of a spectrum of the frequency band determined to be encoded in the frequency domain in operation 970 from a high frequency band above the preset frequency band is extracted and encoded.

The present invention is not limited to an open-loop method in which an encoding domain is firstly selected and then encoding is performed in accordance with the selected domain as described above with reference to FIGS. 9A and 9B. Alternatively, a close-loop method in which encoding is performed both in the time domain and in the frequency domain and then more appropriate domain is selected later by comparing encoding results may be used.

Figure 10A:
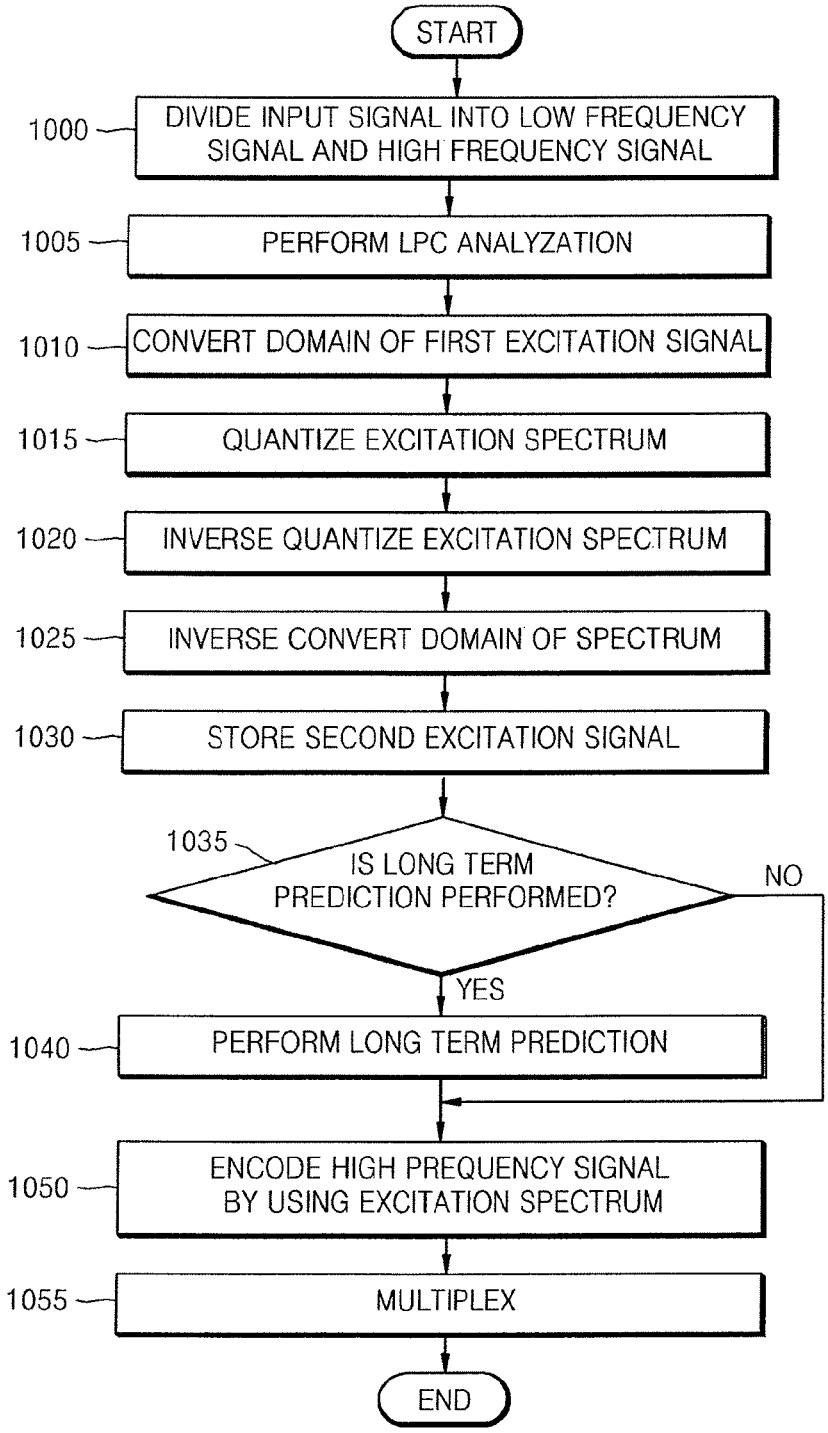
FIG. 10A is a flowchart of a method of adaptively encoding a high frequency band, according to another embodiment of the present invention.

FIG. 10A is a flowchart of a method of adaptively encoding a high frequency band, according to another embodiment of the present invention.

In operation 1000, an input signal is divided into a low frequency signal of a low frequency band below a preset frequency band and a high frequency signal of a high frequency band above the preset frequency band.

In operation 1005, LPC coefficients are extracted by performing an LPC analysis on the low frequency signal divided in operation 1000, and a first excitation signal is extracted by removing short term correlations from the low frequency signal divided in operation 1000.

In operation 1010, an excitation spectrum is generated by converting the first excitation signal extracted in operation 1005 from the time domain to the frequency domain.

In operation 1015, the excitation spectrum generated in operation 1010 is quantized.

In operation 1020, the excitation spectrum quantized in operation 1015 is inverse quantized.

In operation 1025, inverse operation of the conversion performed in operation 1010 is performed by inverse converting the excitation spectrum inverse quantized in operation 1020 from the frequency domain to the time domain, thereby generating a second excitation signal.

In operation 1030, the second excitation signal inverse converted in operation 1025 is stored. The second excitation signal is stored in order to use the second excitation signal when long term prediction is performed in operation 1040 on a signal of a frequency band to be encoded in the time domain from a next frame.

In operation 1035, the first excitation signal extracted in operation 1005 is analyzed and whether to perform the long tem prediction in operation 1040 or not is determined in accordance with characteristics of the low frequency signal. Here, the characteristics of the low frequency signal may be an LPC gain, spectral variations between linear prediction filters of neighboring frames, a pitch delay gain, a long term prediction gain, etc.

In operation 1040, if the long term prediction is determined to be performed in operation 1035, a third excitation signal is extracted by performing the long term prediction on the first excitation signal extracted in operation 1005.

The long term prediction of operation 1040 may be performed by measuring continuity of periodicity, frequency spectral tilt, or frame energies. Here, the continuity of periodicity may be a degree of continuity of frames which have low variations of pitch lags and high pitch correlations over a certain section. Here, the continuity of periodicity may be a degree of continuity of frames which have very low first formant frequencies and high pitch correlations over a certain section.

In operation 1050, the high frequency signal is encoded in the frequency domain by using the excitation spectrum of the low frequency band below the preset frequency band, which is inverse quantized in operation 1020.

In operation 1055, a bitstream is generated by multiplexing the LPC coefficients encoded in operation 1005, the excitation spectrum quantized in operation 1015, the result of the long term prediction performed in operation 1040, and the result encoded in operation 1050.

Figure 10B:
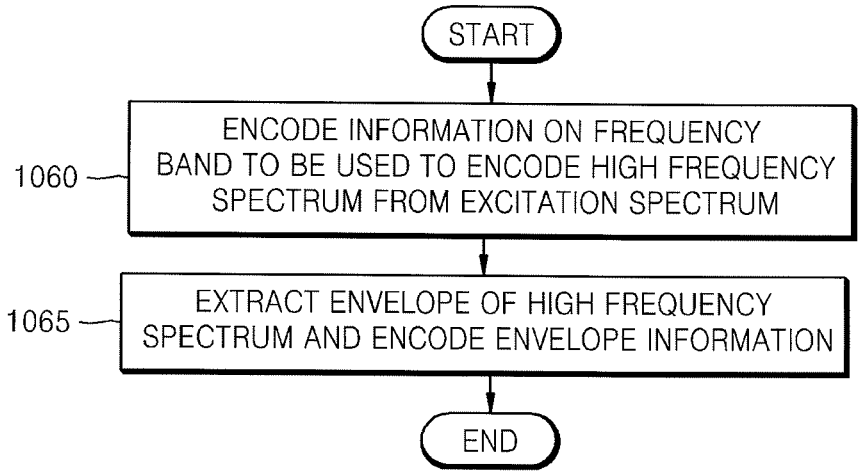
FIG. 10B is a flowchart of operation 1050 included in the method of FIG. 10A, according to an embodiment of the present invention.

FIG. 10B is a flowchart of operation 1050 included in the method of FIG. 10A, according to an embodiment of the present invention.

In operation 1060, information on a frequency band to be used to encode a high frequency spectrum of a high frequency band above a preset frequency band from an excitation spectrum which is inverse quantized in operation 1020 of FIG. 10A is encoded. The information encoded by the noise information encoding unit 1060 is output to the multiplexing unit 1055 illustrated in FIG. 10A through a first output terminal OUT 1.

In operation 1065, a high frequency spectrum is received, and an envelope of the high frequency spectrum is extracted, and information on the extracted envelope is encoded. The envelope information may be energy values calculated by frequency bands.

Figure 11A:
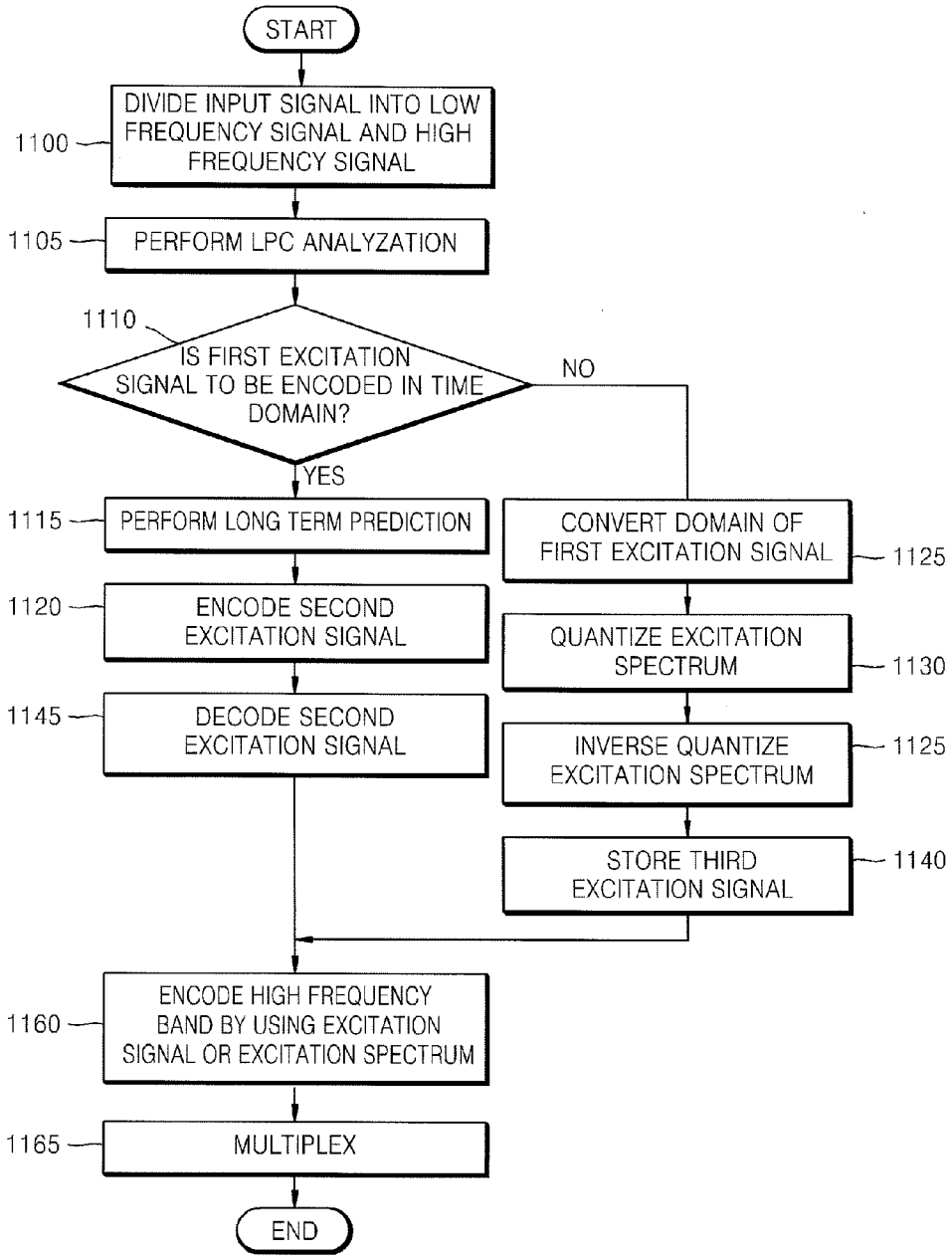
FIG. 11A is a flowchart of a method of adaptively encoding a high frequency band, according to another embodiment of the present invention.

FIG. 11A is a flowchart of a method of adaptively encoding a high frequency band, according to another embodiment of the present invention.

In operation 1100, an input signal is divided into a low frequency signal of a low frequency band below a preset frequency band and a high frequency signal of a high frequency band above the preset frequency band.

In operation 1105, LPC coefficients is extracted by performing an LPC analysis on the low frequency signal divided in operation 1100, and a first excitation signal is extracted by removing short term correlations from the low frequency signal.

In operation 1110, whether to encode the first excitation signal extracted in operation 1105 in the time domain or in the frequency domain is determined in accordance with a preset standard. Here, the preset standard may be an LPC gain, spectral variations between linear prediction filters of neighboring frames, a pitch delay gain, a long term prediction gain, etc.

In operation 1115, if the first excitation signal is determined to be encoded in the time domain in operation 1110, the long term prediction is performed on the first excitation signal extracted in operation 1105 and a second excitation signal is extracted.

The long term prediction of operation 1115 may be performed by measuring continuity of periodicity, frequency spectral tilt, or frame energies. Here, the continuity of periodicity may be a degree of continuity of frames which have low variations of pitch lags and high pitch correlations over a certain section. Here, the continuity of periodicity may be a degree of continuity of frames which have very low first formant frequencies and high pitch correlations over a certain section.

In operation 1120, the second excitation signal extracted in operation 1115 is encoded.

In operation 1125, if the first excitation signal is determined to be encoded in the time domain in operation 1110, a spectrum is generated by converting the first excitation signal extracted in operation 1105 from the time domain to the frequency domain.

In operation 1130, the excitation spectrum generated in operation 1125 is quantized.

In operation 1135, the excitation spectrum quantized in operation 1130 is inverse quantized.

In operation 1140, inverse operation of the conversion performed in operation 1125 is performed by inverse converting the excitation spectrum inverse quantized in operation 1135 from the frequency domain to the time domain.

In operation 1145, the third excitation signal inverse converted in operation 1140 is stored. The third excitation signal is stored in order to use the third excitation signal when the long term prediction is performed in operation 1115 on a signal of a frequency band to be encoded in the time domain from a next frame.

In operation 1150, the second excitation signal encoded in operation 1120 is decoded.

In operation 1160, a high frequency signal of a high frequency band above the preset frequency band is adaptively encoded in the time domain or in the frequency domain by using a signal or spectrum of the low frequency band below the preset frequency band. If the signal is encoded in the time domain, the second excitation signal decoded in operation 1150 is used, and if the signal is encoded in the frequency domain, the excitation spectrum generated in operation 1135 is used.

In operation 1165, a bitstream is generated by multiplexing the LPC coefficients extracted in operation 1105, the result of the long term prediction performed in operation 1115, the information on the encoding domain of the low frequency signal selected in operation 1105, the second excitation signal encoded in operation 1120, the excitation spectrum quantized in operation 1130, and the result encoded in operation 1160.

Figure 11B:
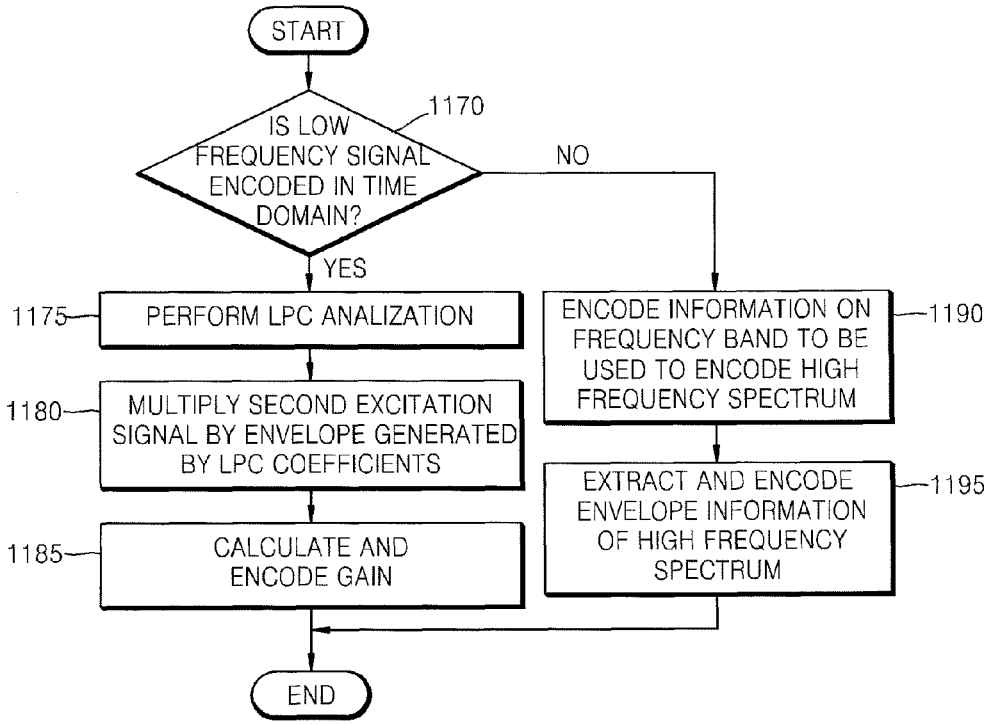
FIG. 11B is a flowchart of operation 1160 included in the method of FIG. 11A, according to an embodiment of the present invention.

FIG. 11B is a flowchart of operation 1160 included in the method of FIG. 11A, according to an embodiment of the present invention.

In operation 1170, whether to encode a high frequency signal of a high frequency band above a preset frequency band in the time domain or in the frequency domain is determined in accordance with an encoding domain of a low frequency signal of a low frequency band below the preset frequency band, the encoding domain selected in operation 1110 of FIG. 11A. If the low frequency signal is determined to be encoded in the frequency domain in operation 1110 of FIG. 11A, the high frequency signal is determined to be encoded in the frequency domain, and if the low frequency signal is determined to be encoded in the time domain in operation 1110 of FIG. 11A, the high frequency signal is determined to be encoded in the time domain.

In operation 1175, if the high frequency signal is determined to be encoded in the time domain in operation 1170, LPC coefficients are extracted by performing an LPC analysis on the high frequency signal. The LPC coefficients extracted in operation 1175 are used to restore an envelope as illustrated in FIG. 7A by a decoder.

In operation 1180, the second excitation signal decoded in operation 1150 of FIG. 11A is multiplied by an envelope of the high frequency signal generated by the LPC coefficients extracted in operation 1175. An example of the signal multiplied in operation 1180 may be the signal 710 illustrated in FIG. 7B.

In operation 1185, a gain which compensates for a mismatch between the signal multiplied in operation 1180 and a low frequency signal is calculated and encoded. The mismatch existing at the boundary between the low frequency signal 720 and the multiplied signal 710 which are illustrated in FIG. 7B is compensated for as illustrated in FIG. 7C.

In operation 1190, a frequency band to be used to decode a high frequency spectrum is selected from the excitation spectrum inverse quantized in operation 1135 of FIG. 11A by the decoder, and information on the selected frequency band is encoded.

In operation 1195, envelope information of the high frequency spectrum is extracted and encoded. The envelope information may be energy values calculated by frequency bands.

The present invention is not limited to an open-loop method in which an encoding domain is firstly selected and then encoding is performed in accordance with the selected domain as described above with reference to FIGS. 11A and 11B. Alternatively, a close-loop method in which encoding is performed both in the time domain and in the frequency domain and then more appropriate domain is selected later by comparing encoding results may be used.

Figure 12A:
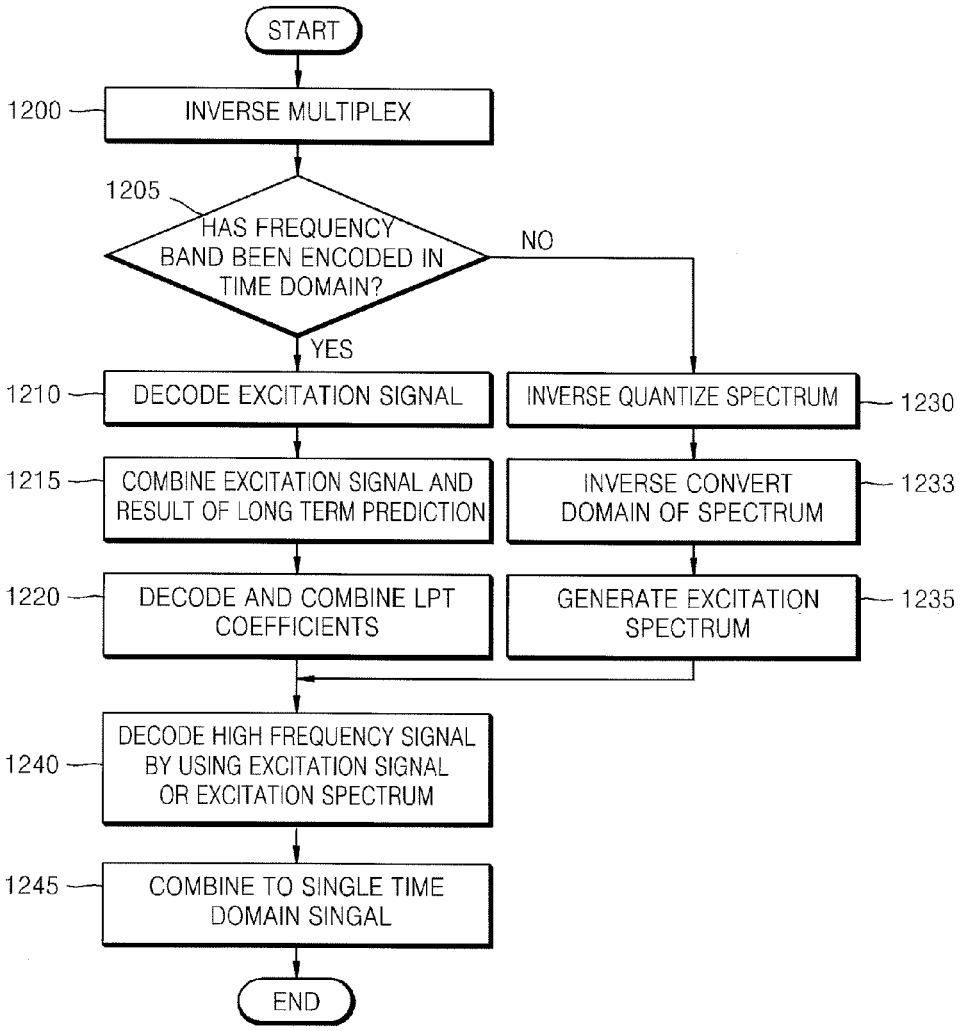
FIG. 12A is a flowchart of a method of adaptively decoding a high frequency band, according to an embodiment of the present invention.

FIG. 12A is a flowchart of a method of adaptively decoding a high frequency band, according to an embodiment of the present invention.

In operation 1200, a bitstream input from an encoder is inverse multiplexed. The inverse multiplexing is performed on information on an encoding domain of a frequency band encoded by the encoder, LPC coefficients encoded by the encoder, a result of long term prediction performed by the encoder, an excitation signal encoded by the encoder, a spectrum quantized by the encoder, and information required for decoding a high frequency signal by using a low frequency signal or a low frequency spectrum.

In operation 1205, the information on the encoding domain of a low frequency band below a preset frequency band, which is encoded by the encoder, is received and the encoding domain of each frequency band is determined.

In operation 1210, the excitation signal of a frequency band determined as having been encoded in the time domain in operation 1205, the excitation signal encoded by the encoder, is decoded.

In operation 1215, the result of the long term prediction performed by the encoder on the frequency band determined as having been encoded in the time domain in operation 1205 is decoded, and the excitation signal decoded in operation 1210 and the result of the long term prediction are combined.

In operation 1220, the LPC coefficients of the frequency band determined as having been encoded in the time domain in operation 1205 are decoded, and the LPC coefficients and the signal combined in operation 1215 are combined.

In operation 1230, the spectrum of the frequency band determined as having been encoded in the frequency domain in operation 1205 is inverse quantized.

In operation 1233, inverse operation of the conversion performed in operation 1225 of FIG. 9A is performed by inverse converting the spectrum inverse quantized in operation 1230 from the frequency domain to the time domain.

In operation 1235, an excitation spectrum is generated by whitening the spectrum inverse quantized in operation 1230.

In operation 1240, a high frequency signal of a high frequency band above the preset frequency band is decoded by using the excitation signal decoded in operation 1210 or the excitation spectrum generated in operation 1235.

In operation 1245, inverse operation of the conversion performed in operation 900 illustrated in FIG. 9A is performed. The inverse conversion is performed by combining the signal combined in operation 1220 or the spectrum inverse converted in operation 1233 and the high frequency signal decoded in operation 1240 into a time domain signal. The inverse conversion may be performed by using a QMF method or an LOT method.

However, a time domain signal and a frequency domain signal by frequency bands may be combined into a time domain signal by using, for example, a FV-MLT method. In this case, an additional operation for converting a frequency domain signal into a time domain signal may not be performed.

Figure 12B:
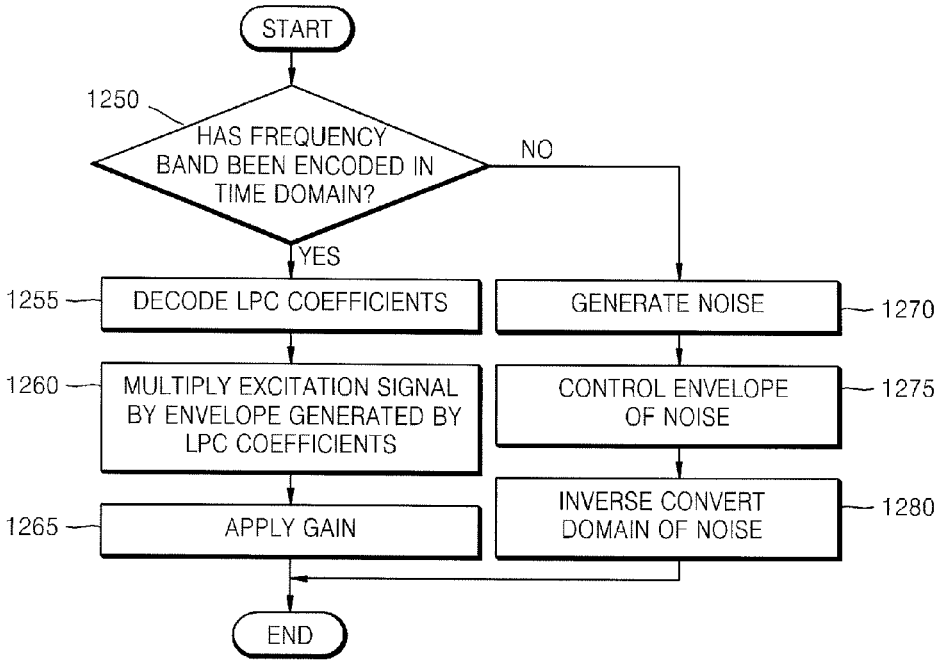
FIG. 12B is a flowchart of operation 1240 included in the method of FIG. 12A, according to an embodiment of the present invention.

FIG. 12B is a flowchart of operation 1240 included in the method of FIG. 12A, according to an embodiment of the present invention.

In operation 1250, whether a signal of a high frequency band above a preset frequency band has been encoded in the time domain or in the frequency domain is determined. An encoding domain of each frequency band may be determined by using information on an encoding domain, which is transmitted from an encoder or by using information on a decoded domain of a low frequency band below the preset frequency band, which is used when the high frequency band is decoded in operation 1205 of FIG. 12A.

In operation 1255 LPC coefficients of a frequency band determined as having been encoded in the time domain are decoded. By the LPC coefficients decoded in operation 1255, an envelope may be restored as illustrated in FIG. 7A.

In operation 1260, the excitation signal decoded in operation 1210 of FIG. 12A is multiplied by an envelope generated by the LPC coefficients decoded in operation 1255. An example of the signal multiplied in operation 1260 may be the signal 710 illustrated in FIG. 7B.

In operation 1265, the gain is decoded and applied to the signal multiplied in operation 1260. By applying the gain, a mismatch between a decoded low frequency signal and a decoded high frequency signal may be compensated for. For example, the high frequency signal multiplied in operation 1260 has the mismatch at the boundary to the low frequency signal as illustrated in FIG. 7B. However, when the gain is applied to, the mismatch does not exist between the low frequency signal and the high frequency signal as illustrated in FIG. 7C.

In operation 1270, information on a frequency band to be used to decode a high frequency spectrum from the excitation spectrum generated in operation 1235 of FIG. 12A is decoded. Noise is generated by patching or symmetrically folding the excitation spectrum of the corresponding frequency band to the frequency band determined to be encoded in the frequency domain in operation 1250. For example, an excitation spectrum illustrated in FIG. 8A is patched to the high frequency band as illustrated in FIG. 8B.

In operation 1275, envelope information of a high frequency spectrum encoded by the encoder is decoded. An envelope of the noise generated in operation 1270 is controlled by using the envelope information of the high frequency spectrum decoded in operation 1275. For example, the noise generated in operation 1270 of in FIG. 8B is controlled to an envelope illustrated in FIG. 8C by using the envelope information of the high frequency spectrum.

In operation 1280, inverse operation of the conversion performed in operation 925 illustrated in FIG. 9A is performed by inverse converting the noise of which envelope is controlled in operation 1275 from the frequency domain to the time domain, thereby generating a high frequency signal.

Figure 13A:
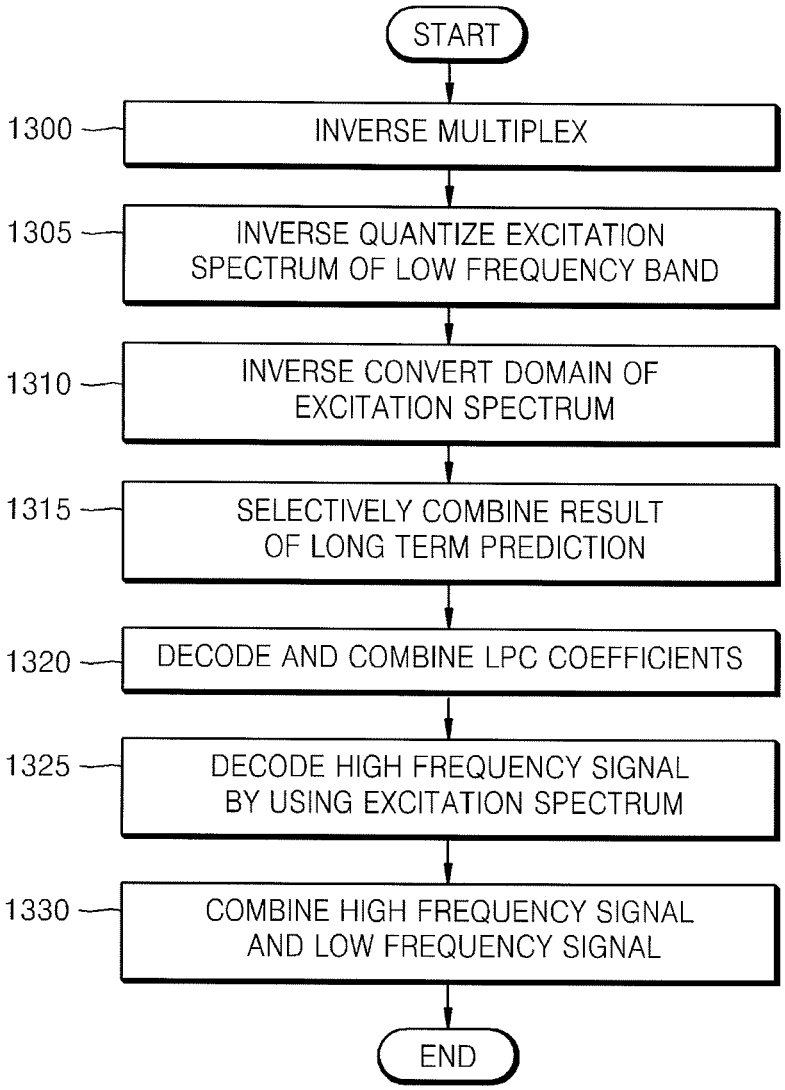
FIG. 13A is a flowchart of a method of adaptively decoding a high frequency band, according to another embodiment of the present invention.

FIG. 13A is a flowchart of a method of adaptively decoding a high frequency band, according to another embodiment of the present invention.

In operation 1300 a bitstream input from an encoder is inverse multiplexed. The inverse multiplexing is performed on LPC coefficients encoded by the encoder, an excitation spectrum encoded by the encoder, a result of long term prediction performed by the encoder, and information required for decoding a high frequency signal of a high frequency band above a preset frequency band by using an excitation spectrum of a low frequency band below the preset frequency band.

In operation 1305, the low frequency excitation spectrum quantized by the encoder is inverse quantized.

In operation 1310, inverse operation of the conversion performed in operation 1010 of FIG. 10A is performed by inverse converting the excitation spectrum inverse quantized in operation 1305 from the frequency domain to the time domain, thereby generating an excitation signal.

In operation 1315, the result of the long term prediction performed by the encoder on the low frequency excitation signal is decoded, and the excitation signal generated in operation 1310 and the result of the long term prediction are selectively combined. The combining of the result of the long term prediction is performed when the result of the long term prediction performed by the encoder on the excitation signal is transmitted from the encoder.

In operation 1320, the LPC coefficients are decoded. After the LPC coefficients are decoded in operation 1320, if the result of the long term prediction is not combined, the excitation signal generated in operation 1310 is combined with the LPC coefficients, and if the result of the long term prediction is combined, the signal combined in operation 1315 is combined with the LPC coefficients. The signal combined in operation 1320 is a restored low frequency signal of a low frequency band.

In operation 1325, a high frequency signal is decoded by using the excitation spectrum of the low frequency signal inverse quantized in operation 1305.

In operation 1330, the low frequency signal restored in operation 1320 and the high frequency signal decoded in operation 1325 are combined.

Figure 13B:
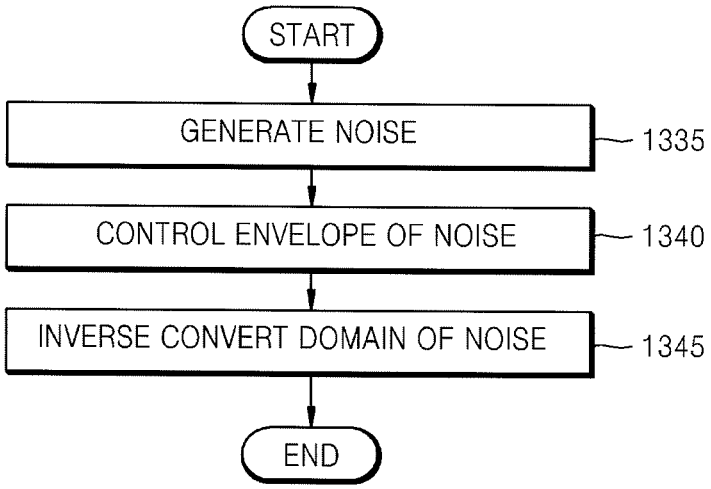
FIG. 13B is a flowchart of operation 1325 included in the method of FIG. 13A, according to an embodiment of the present invention.

FIG. 13B is a flowchart of operation 1325 included in the method of FIG. 13A, according to an embodiment of the present invention.

In operation 1335, information on a frequency band to be used to decode a high frequency spectrum from an excitation spectrum of a low frequency band below a preset frequency band is decoded. An excitation spectrum to be used is selected from excitation spectrums inverse quantized in operation 1305 in accordance with the decoded information, and noise is generated by patching or symmetrically folding the corresponding excitation spectrum to a high frequency band above the preset frequency band. For example, the excitation spectrum illustrated in FIG. 8A is patched to the high frequency band as illustrated in FIG. 8B.

In operation 1340, envelope information of a high frequency spectrum encoded by the encoder is decoded. An envelope of the noise generated in operation 1335 is controlled by using the envelope information of the high frequency spectrum. For example, the noise generated in operation 1335 as illustrated in FIG. 8B is controlled to an envelope illustrated in FIG. 8C by using the envelope information of the high frequency spectrum.

In operation 1345, inverse operation of the conversion performed in operation 1010 illustrated in FIG. 10A is performed by inverse converting the noise of which envelope is controlled in operation 1340 from the frequency domain to the time domain, thereby generating a high frequency signal.

Figure 14A:
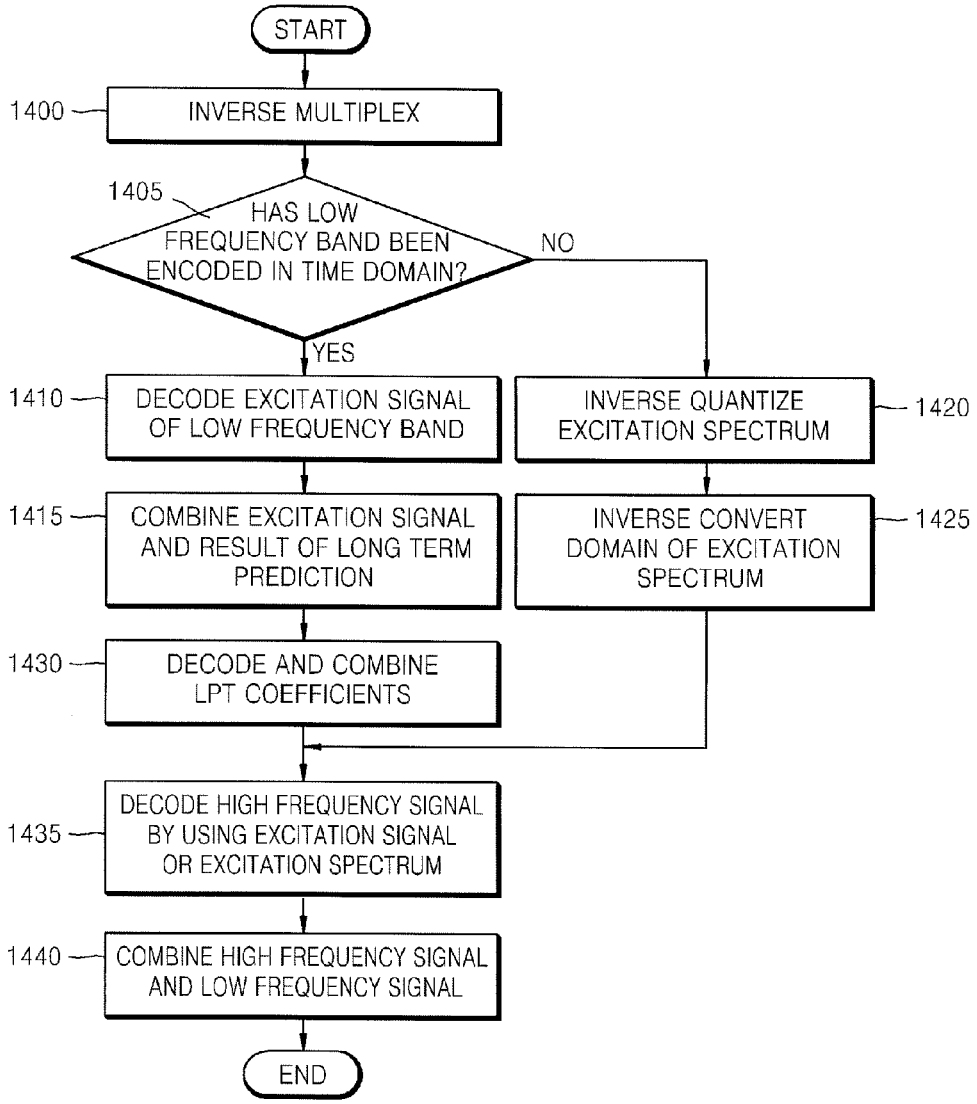
FIG. 14A is a flowchart of a method of adaptively decoding a high frequency band, according to another embodiment of the present invention.

FIG. 14A is a flowchart of a method of adaptively decoding a high frequency band, according to another embodiment of the present invention.

In operation 1400, a bitstream input from an encoder is inverse multiplexed. The inverse multiplexing is performed on information on an encoding domain of a low frequency signal selected by the encoder, LPC coefficients encoded by the encoder, a result of long term prediction performed by the encoder, an excitation spectrum quantized by the encoder, and information required for decoding a high frequency signal by using a low frequency signal or a low frequency spectrum of a low frequency band below a preset frequency band.

In operation 1405, the information on the encoding domain of the low frequency band encoded by the encoder is decoded, and whether the low frequency band has been encoded in the time domain or in the frequency domain is determined.

In operation 1410, if the low frequency band is determined as having been encoded in the time domain in operation 1405, an excitation signal of the low frequency band encoded by the encoder is decoded.

In operation 1415, the result of the long term prediction performed by the encoder on the low frequency band signal is decoded, and the excitation signal decoded in operation 1410 and the result of the long term prediction are combined.

In operation 1420, if the low frequency band is determined as having been encoded in the frequency domain in operation 1405, an excitation spectrum quantized by the encoder is inverse quantized.

In operation 1425, inverse operation of the conversion performed in operation 1125 of FIG. 11A is performed by inverse converting the excitation spectrum inverse quantized in operation 1420 from the frequency domain to the time domain, thereby generating an excitation signal.

In operation 1430, the LPC coefficients of the low frequency signal are decoded, and the decoded LPC coefficients are combined with the excitation signal combined in operation 1415 or the excitation signal generated in operation 1425. The signal combined in operation 1430 is a restored low frequency signal of a low frequency band.

In operation 1435, the high frequency signal is decoded by using the excitation spectrum inverse quantized in operation 1420 or the excitation signal decoded in operation 1410. If the low frequency band has been encoded in the time domain, the high frequency signal is decoded by using the excitation spectrum inverse quantized in operation 1420, and if the low frequency band has been encoded in the frequency domain, the high frequency signal is decoded by using the excitation spectrum decoded in operation 1410.

In operation 1440, the low frequency signal restored in operation 1430 and the high frequency signal decoded in operation 1325 are combined.

Figure 14B:
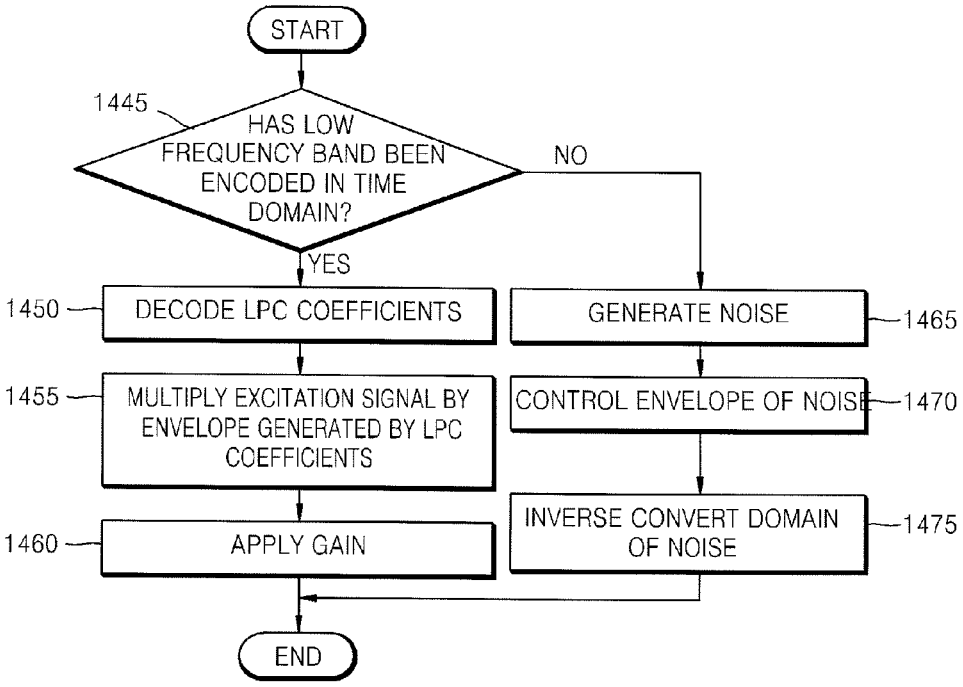
FIG. 14B is a flowchart of operation 1435 included in the method of FIG. 14A, according to an embodiment of the present invention.

FIG. 14B is a flowchart of operation 1435 included in the method of FIG. 14A, according to an embodiment of the present invention.

In operation 1445, whether to decode a high frequency band above a preset frequency band in the time domain or in the frequency domain is determined by determining an encoding domain of a low frequency band below the preset frequency band.

In operation 1450, if the high frequency band is determined to be decoded in the time domain, LPC coefficients of a high frequency signal are decoded. By the LPC coefficients decoded in operation 1450, an envelope may be restored as illustrated in FIG. 7A.

In operation 1455, the excitation signal which is decoded in operation 1410 of FIG. 14A is multiplied by the envelope generated by the LPC coefficients decoded in operation 1450. An example of the signal multiplied in operation 1455 may be the signal 710 illustrated in FIG. 7B.

In operation 1460, a gain encoded by the encoder is decoded, and the gain is applied to the signal multiplied in operation 1455. By applying the gain, a mismatch between a low frequency signal and a high frequency signal, which are restored in operation 1430 of FIG. 14A, may be compensated for. For example, the high frequency signal multiplied in operation 1455 has the mismatch at the boundary to the low frequency signal as illustrated in FIG. 7B. However, when the gain is applied to, the mismatch does not exist between the low frequency signal and the high frequency signal as illustrated in FIG. 7C.

In operation 1465, if the high frequency band is determined to be decoded in the frequency domain in operation 1445, a spectrum is generated by patching or symmetrically folding an excitation spectrum inverse quantized in operation 1420 of FIG. 14A to the high frequency band. For example, the excitation spectrum illustrated in FIG. 8A is patched to the high frequency band as illustrated in FIG. 8B.

In operation 1470, envelope information of a high frequency spectrum encoded by the encoder is received and decoded. An envelope of the noise generated in operation 1465 is controlled by using the decoded envelope information of the high frequency spectrum. For example, the noise generated in operation 1465 as illustrated in FIG. 8B is controlled to the envelope illustrated in FIG. 8C by using the envelope information of the high frequency spectrum.

In operation 1475, inverse operation of the conversion performed in operation 1125 of FIG. 11A is performed by inverse converting the noise of which envelope is controlled in operation 1470 from the frequency domain to the time domain, thereby generating a high frequency signal.

The present invention can also be embodied as computer readable code on a computer readable recording medium. The computer readable recording medium is any data storage device that can store data which can be thereafter read by a computer system. Examples of the computer readable recording medium include read-only memory (ROM), random-access memory (RAM), CD-ROMs, magnetic tapes, floppy disks, optical data storage devices, and carrier waves.

As described above, according to the present invention, a signal of a high frequency band above a preset frequency band is adaptively encoded or decoded in the time domain or in the frequency domain by using a signal of a low frequency band below the preset frequency band.

As such, the sound quality of a high frequency signal is not deteriorate even when an audio signal is encoded or decoded by using a small number of bits and thus coding efficiency may be maximized.

While the present invention has been particularly shown and described with reference to exemplary embodiments thereof, it will be understood by those of ordinary skill in the art that various changes in form and details may be made therein without departing from the spirit and scope of the invention as defined by the appended claims. The exemplary embodiments should be considered in a descriptive sense only and not for purposes of limitation. Therefore, the scope of the invention is defined not by the detailed description of the invention but by the appended claims, and all differences within the scope will be construed as being included in the present invention.

What is claimed is:

1. An apparatus for encoding an upper band, the apparatus comprising:

a time domain encoding unit to encode a high band signal based on a low band excitation signal, when it is determined that the high band is encoded in a time domain; and a frequency domain encoding unit to encode the high band signal based on an envelope of the high band signal, when it is determined that the high band signal is encoded in a frequency domain.

2. The apparatus of claim 1, wherein the time domain encoding unit is configured to encode a gain value for the high band signal.

3. The apparatus of claim 1, wherein the frequency domain encoding unit is configured to encode noise information for the high band signal.

* * * * *